US012048373B2

(12) United States Patent
Schreiber et al.

(10) Patent No.: US 12,048,373 B2
(45) Date of Patent: Jul. 30, 2024

(54) COSMETIC APPLICATOR

(71) Applicant: L'Oreal, Paris (FR)

(72) Inventors: Camille Schreiber, Clichy (FR); Audrey Thenin, Clichy (FR)

(73) Assignee: L'OREAL, Paris (FR)

( * ) Notice: Subject to any disclaimer, the term of this patent is extended or adjusted under 35 U.S.C. 154(b) by 16 days.

(21) Appl. No.: 16/644,069

(22) PCT Filed: Sep. 12, 2018

(86) PCT No.: PCT/EP2018/074656
§ 371 (c)(1),
(2) Date: Mar. 3, 2020

(87) PCT Pub. No.: WO2019/053087
PCT Pub. Date: Mar. 21, 2019

(65) Prior Publication Data

US 2021/0361057 A1 Nov. 25, 2021

(30) Foreign Application Priority Data

Sep. 12, 2017 (FR) ..... 1758406

(51) Int. Cl.
*A46B 9/02* (2006.01)
*A45D 40/26* (2006.01)
*A46B 3/00* (2006.01)

(52) U.S. Cl.
CPC ..... *A46B 9/021* (2013.01); *A45D 40/264* (2013.01); *A45D 40/265* (2013.01); *A46B 3/005* (2013.01);
(Continued)

(58) Field of Classification Search
CPC ..... A46B 9/021; A46B 3/005; A46B 9/028; A46B 2200/1053; A46B 3/00;
(Continued)

(56) References Cited

U.S. PATENT DOCUMENTS 722,714 A 3/1903 Kahn
731,575 A * 6/1903 Johnston ..... A45D 8/12 132/106
(Continued)

FOREIGN PATENT DOCUMENTS

CA 2300665 A1 9/2000
CN 1317946 A 10/2001
(Continued)

OTHER PUBLICATIONS

Botto Paolo, "EP-2196106-A1-translated" (Year: 2010).*
(Continued)

*Primary Examiner* — Jacqueline T Johanas
*Assistant Examiner* — Holly T. To
(74) *Attorney, Agent, or Firm* — Shumaker, Loop & Kendrick, LLP

(57) ABSTRACT

An applicator for applying a cosmetic composition to the eyelashes or eyebrows including a core, at least one element attached to the core, each element including a central part fitted onto the core and at least one application member carried by the central part, this application member being hollow and comprising at least one cavity passing through it in one direction and having a closed or almost closed contour when viewed in this direction, and/or at least two adjacent application members forming at least one almost closed cavity between one another.

31 Claims, 13 Drawing Sheets

(52) U.S. Cl.
CPC ..... *A46B 9/028* (2013.01); *A46B 2200/1053* (2013.01)

(58) Field of Classification Search
CPC ..... A46B 2200/01; A46B 2200/1046; A46B 9/02; A46B 9/025; A46B 9/06; A46B 2200/106; A46B 9/00; A45D 40/264; A45D 40/265; A45D 40/262; A45D 34/042; A45D 34/045; A45D 24/02; A45D 8/12; A46D 1/0253; A46D 1/0238; A46D 1/02; A46D 1/00; A46D 1/0246; A46D 1/0276; A46D 1/0292; A46D 1/0269
USPC ..... 132/200; D4/133, 128, 136
See application file for complete search history.

(56) References Cited

U.S. PATENT DOCUMENTS 735,643 A 8/1903 Winn
739,898 A * 9/1903 Montain ..... A45D 8/12 132/157
748,420 A * 12/1903 Richardson ..... A45D 8/12 132/157
864,124 A * 8/1907 Dunbar ..... A45D 8/12 132/157
912,355 A * 2/1909 Becken ..... A45D 8/12 132/157
1,094,013 A * 4/1914 Peterson ..... A45D 24/02 132/137
2,196,815 A 4/1940 Sawyer
2,299,770 A * 10/1942 Solomon ..... A45D 8/12 132/157
2,329,361 A * 9/1943 Solomon ..... A45D 8/12 132/157
2,348,339 A * 5/1944 Golden ..... A45D 24/02 132/901
2,372,080 A * 3/1945 Hahn ..... A45D 8/12 132/157
2,446,781 A * 8/1948 Norin ..... A45D 8/12 132/157
2,450,448 A * 10/1948 Sawyer ..... B29C 67/00 264/328.8
2,478,872 A * 8/1949 Leblanc ..... B29D 21/00 264/DIG. 66
2,479,631 A * 8/1949 Liebert ..... A45D 8/12 132/129
2,508,799 A 5/1950 Reis, Jr.
2,559,940 A * 7/1951 Cartheuser ..... A45D 8/12 132/156
2,566,965 A * 9/1951 Shaw ..... A45D 8/12 132/156
2,574,891 A * 11/1951 Sawyer ..... A45D 8/12 132/157
2,577,098 A * 12/1951 Wood ..... A45D 8/12 D28/32
2,669,239 A * 2/1954 Smith ..... A45D 8/12 24/546
D179,923 S 3/1957 Solomon
2,806,476 A * 9/1957 Thompson ..... A45D 8/12 132/901
2,814,302 A * 11/1957 Nash ..... A42B 5/00 D28/32
2,844,154 A * 7/1958 Solomon ..... A45D 8/12 D28/32
2,915,071 A * 12/1959 Rufus ..... A45D 24/02 132/901
3,120,852 A * 2/1964 Sawyer ..... A45D 8/12 132/156
3,214,777 A * 11/1965 Kutik ..... A46B 1/00 15/207.2
3,256,545 A * 6/1966 Lewis, Jr. ..... A46D 1/0238 15/207.2
3,459,199 A * 8/1969 Connell ..... A45D 24/10 132/119.1
3,575,183 A * 4/1971 Tanner, Sr. ..... A45D 24/02 D28/21
3,872,873 A * 3/1975 Tupper ..... A45D 24/00 132/159
4,030,845 A * 6/1977 Deckert ..... A46B 11/00 401/268
4,461,312 A * 7/1984 Gueret ..... A46B 9/021 15/207.2
4,493,126 A * 1/1985 Uy ..... B44D 3/162 15/236.08
4,504,998 A * 3/1985 Price ..... A46D 1/00 15/186
4,522,215 A * 6/1985 Verducci ..... A45D 8/12 132/219
4,561,456 A 12/1985 Gueret
4,616,374 A * 10/1986 Novogrodsky ..... A46B 9/04 15/207.2
5,191,670 A * 3/1993 Lake ..... A46D 1/00 15/207.2
D341,718 S * 11/1993 Briganti ..... D4/133
D345,440 S 3/1994 Van Dyk
5,386,839 A * 2/1995 Chen ..... A46B 7/02 132/160
5,694,953 A * 12/1997 Stephan ..... A45D 24/00 132/270
5,881,426 A * 3/1999 Tong ..... A46B 9/023 15/207.2
5,926,904 A * 7/1999 Warner ..... A46B 13/001 15/198
6,016,815 A * 1/2000 Christoforou ..... A46B 3/18 401/122
6,045,911 A * 4/2000 Legrand ..... A01D 34/4168 30/356
6,086,373 A * 7/2000 Schiff ..... A46D 1/00 15/167.1
6,141,818 A * 11/2000 Weihrauch ..... D02G 1/14 15/207.2
D453,076 S 1/2002 Naghibi
6,343,607 B1 * 2/2002 Gueret ..... A46B 9/023 132/218
6,412,496 B1 * 7/2002 Gueret ..... A45D 40/267 15/207.2
6,450,177 B1 * 9/2002 Christoforu ..... A46D 1/00 132/218
6,616,366 B1 * 9/2003 Weihrauch ..... A46B 7/023 132/218
RE38,397 E 1/2004 Gueret
6,866,046 B2 * 3/2005 Gueret ..... A46B 9/021 132/218
D591,955 S 5/2009 Kulik
7,654,270 B2 * 2/2010 Gueret ..... A46D 1/0253 15/207.2
7,992,577 B2 * 8/2011 De Brouwer ..... A45D 34/045 132/218
8,091,562 B2 1/2012 Manici et al.
8,210,763 B2 7/2012 Gueret
8,336,560 B2 12/2012 Dumler et al.
D677,904 S 3/2013 Hammer
8,438,689 B2 5/2013 Noble
8,474,086 B1 7/2013 Smith
8,794,247 B2 * 8/2014 Kulik ..... A46B 9/06 15/207.2
8,899,241 B2 12/2014 Vandromme
8,905,050 B2 * 12/2014 Gueret ..... A46B 9/028 132/218
8,919,351 B1 * 12/2014 Wang ..... A46B 9/021 132/218
9,254,028 B2 2/2016 Gueret
D757,445 S 5/2016 Rutigliano et al.
D757,455 S 5/2016 Rutgliano et al.
9,370,234 B2 6/2016 Lhoyer
9,420,874 B2 8/2016 Castex et al.
9,427,075 B2 8/2016 Gueret
9,591,916 B2 3/2017 Kim
10,973,312 B2 4/2021 Pires et al.

(56) References Cited

U.S. PATENT DOCUMENTS

2001/0035191 A1* 11/2001 Lee ..... A46D 1/00 132/901
2002/0020424 A1* 2/2002 Gueret ..... A46B 9/021 132/218
2002/0138929 A1* 10/2002 Mehta ..... A47K 7/02 601/129
2003/0150075 A1 8/2003 Montoli et al.
2003/0163884 A1* 9/2003 Weihrauch ..... A46B 9/021 15/186
2003/0213949 A1 11/2003 Gueret
2003/0230317 A1* 12/2003 Montoli ..... A46D 1/0246 132/218
2004/0244809 A1* 12/2004 Gueret ..... A46D 1/00 132/218
2005/0160546 A1* 7/2005 Weihrauch ..... B29C 45/34 428/397
2005/0285439 A1 12/2005 Kubaitis
2006/0054179 A1* 3/2006 Kuzuu ..... A46B 9/021 132/218
2006/0236484 A1* 10/2006 Lee ..... A46D 1/0253 15/167.1
2007/0034223 A1* 2/2007 Dumler ..... A45D 40/262 132/218
2007/0062552 A1* 3/2007 De Brouwer ..... A45D 34/045 132/218
2008/0142034 A1* 6/2008 Manici ..... A46B 9/021 401/121
2009/0133707 A1* 5/2009 Gueret ..... A45D 40/265 401/121
2009/0193602 A1* 8/2009 Dumler ..... A46B 9/021 15/207.2
2009/0194128 A1 8/2009 Vandromme
2009/0211047 A1* 8/2009 Chen ..... A46D 1/00 15/207.2
2010/0037911 A1* 2/2010 Kim ..... A46B 9/021 132/218
2010/0071715 A1* 3/2010 Bickford ..... A46B 9/021 132/218
2010/0310295 A1* 12/2010 Gueret ..... A46B 1/00 401/122
2011/0041867 A1* 2/2011 Hsu ..... A45D 8/36 132/276
2011/0229246 A1* 9/2011 Kulik ..... A46B 9/021 132/218
2012/0090635 A1* 4/2012 Hsu ..... A45D 8/38 132/275
2012/0167910 A1 7/2012 Weigel
2012/0192892 A1 8/2012 Kulik
2013/0000663 A1* 1/2013 Jacob ..... A46B 9/021 15/207.2
2013/0055518 A1* 3/2013 Jacob ..... A46D 1/02 15/207.2
2013/0133692 A1* 5/2013 Withers ..... A61B 1/122 15/207.2
2014/0003857 A1* 1/2014 Gueret ..... A45D 40/262 132/218
2014/0016985 A1* 1/2014 Osvaldo ..... A46D 1/0253 132/218
2014/0105667 A1* 4/2014 Castex ..... A45D 40/265 132/218
2015/0024080 A1* 1/2015 Jacob ..... A46D 1/0253 425/542
2015/0071695 A1 3/2015 Kamm
2015/0335133 A1* 11/2015 Kim ..... A46B 9/021 401/118
2016/0022012 A1* 1/2016 Jacob ..... A46D 1/0238 401/129
2016/0023388 A1* 1/2016 Jacob ..... A46D 1/0261 425/542
2016/0073767 A1 3/2016 Sanchez et al.
2016/0143419 A1 5/2016 Sanchez et al.
2016/0295996 A1 10/2016 Rutigliano et al.
2016/0360859 A1 12/2016 Uresti et al.
2017/0000242 A1* 1/2017 Jacob ..... A45D 40/267
2017/0238678 A1* 8/2017 Manici ..... A45D 40/267
2017/0290291 A1* 10/2017 Moeller ..... A46D 1/0253
2017/0290412 A1* 10/2017 Pires ..... A46B 9/028
2018/0008028 A1* 1/2018 Kim ..... A46B 9/021
2018/0242714 A1* 8/2018 De Bardonneche ..... A46D 1/0292
2018/0295965 A1* 10/2018 Buck, Jr. ..... A45D 24/36
2021/0169210 A1* 6/2021 Chu ..... A46D 1/0276
2021/0186183 A1* 6/2021 Crapet ..... A46B 9/005

FOREIGN PATENT DOCUMENTS

CN 1868369 A 11/2006
CN 101496673 A 8/2009
CN 102525090 A 7/2012
DE 202011050794 U1 9/2011
DE 202011050794 U1 * 9/2011
DE 20201001472 U1 1/2012
DE 202010014792 U1 1/2012
DE 202010017159 U1 4/2012
EP 0038524 A2 10/1981
EP 0103205 A1 3/1984
EP 0250680 A1 1/1988
EP 0717944 A1 6/1996
EP 1034722 A2 9/2000
EP 1767118 A1 3/2007
EP 2005857 A1 12/2008
EP 2196106 A1 6/2010
EP 2196106 A1 * 6/2010 ..... A45D 40/265
EP 2281478 A2 2/2011
EP 2389833 A2 11/2011
FR 2900319 A1 * 11/2007
FR 2900319 A1 11/2007
FR 2906692 A1 4/2008
FR 3011168 A1 4/2015
FR 3032869 A1 8/2016
FR 3032869 A1 * 8/2016
WO 0158309 A1 8/2001
WO 02056726 A2 7/2002
WO 2010013213 A2 2/2010
WO 2010067314 A1 6/2010
WO 2011013098 A1 2/2011
WO 2012123675 A1 9/2012
WO 2012137134 A1 10/2012
WO 2014195914 A1 12/2014
WO WO-2017098134 A1 * 6/2015
WO 2015110853 A1 7/2015
WO WO-2015110853 A1 * 7/2015
WO 2016055649 A1 4/2016
WO WO-2016055649 A1 * 4/2016
WO WO-2020127707 A1 * 6/2020
WO WO-2020127756 A1 * 6/2020 ..... A46B 1/00

OTHER PUBLICATIONS

Marcia Sue Taylor "Alaska Native Artifacts; Eskimos and Aleuts of the Bering Sea Rhythm of the Sea Collection" (Year: 2017).*
1 Non-Final Office Action for U.S. Appl. No. 16/644,080 mailed Oct. 12, 2021 (23 pages).
Non-Final Office Action for U.S. Appl. No. 16/644,027 mailed Nov. 23, 2021 (28 pages).
Non-Final Office Action for U.S. Appl. No. 16/643,718 mailed Nov. 22, 2021 (12 pages).
Non-Final Office Action for U.S. Appl. No. 16/644,016 mailed Jan. 14, 2022 (23 pages).
English Translation and Office Action for Chinese Pat. Application No. 201880059372.8, mailed Feb. 9, 2021 (13 pages).
International Search Report (ISR) for PCT/EP2018/074643 mailed Oct. 4, 2018 (4 pages).
Written Opinion of the International Searching Authority for PCT/EP2018/074643 mailed Oct. 4, 2018 (5 pages).
International Search Report (ISR) for PCT/EP2018/074648 mailed Oct. 4, 2018 (4 pages).
Written Opinion of the International Searching Authority for PCT/EP2018/074648 mailed Oct. 4, 2018 (5 pages).

(56) References Cited

OTHER PUBLICATIONS

International Search Report (ISR) for PCT/EP2018/074652 mailed Oct. 4, 2018 (4 pages).
Written Opinion of the International Searching Authority for PCT/EP2018/074652 mailed Oct. 4, 2018 (5 pages).
International Search Report (ISR) for PCT/EP2018/074641 mailed Oct. 4, 2018 (4 pages).
Written Opinion of the International Searching Authority for PCT/EP208/074641 mailed Oct. 4, 2018 (5 pages).
International Search Report (ISR) for PCT/EP2018/074656 mailed Oct. 8, 2018 (4 pages).
Written Opinion of the International Searching Authority for PCT/EP2018/074656 mailed Oct. 8, 2018 (6 pages).
Final Rejection for U.S. Appl. No. 16/644,080 mailed Feb. 8, 2022 (30 pages).
Final Rejection for U.S. Appl. No. 16/643,718 mailed Jun. 29, 2022 (14 pages).
1 Non-Final Office Action for U.S. Appl. No. 16/644,080 mailed Jul. 7, 2022 (23 pages).
De Bardonneche "FR 3032869 A1_translated" (Year: 2016) (6 pages).
Final Rejection (FR) for U.S. Appl. No. 16/644,080, mailed Jan. 31, 2023 (34 pages).
Non-Final Office Action (NFOA) for U.S. Appl. No. 16/644,016, mailed Oct. 25, 2022 (20 pages).
Final Rejection for U.S. Appl. No. 16/644,027 mailed Sep. 2, 2022 (20 pages).
Liaw et al., "Plastic Deformation", 2009, ScienceDirect (Year: 2009) (11 pages).
Non-Final Office Action (NFOA) for U.S. Appl. No. 16/644,027, mailed Dec. 28, 2022 (29 pages).
Non-Final Office Action (NFOA) for U.S. Appl. No. 16/643,718, mailed Jan. 3, 2023 (21 pages).
Non-Final Office Action (NFOA) issued for U.S. Appl. No. 16/643,718 mailed Jan. 3, 2023 (21 pages).
Misselhorn, "DE_202010017159_U1_I_translated" (Year: 2012).
Final Rejection issued for U.S. Appl. No. 16/644,016, mailed May 8, 2023 (30 pages).
Dictonary.com, Cross Definition, 2002 (Year: 2002).
Final Rejection (FR) issued for U.S. Appl. No. 16/644,027 mailed Aug. 21, 2023 (28 pages).
Non-Final Office Action (NFOA) issued for U.S. Appl. No. 16/644,080 mailed Jul. 19, 2023 (42 pages).
Final Rejection issued for U.S. Appl. No. 16/643,718 mailed Jul. 21, 2023 (25 pages).
Non-Final Office Action issued for U.S. Appl. No. 16/644,027, mailed Jan. 22, 2024 (30 pages).
Non-Final Office Action (NFOA) issued for U.S. Appl. No. 16/643,718 mailed Dec. 5, 2023 (24 pages).
Non-Final Office Action for U.S. Appl. No. 16/644,016, mailed Oct. 3, 2023 (39 pages).
Final Rejection (FR) issued for U.S. Appl. No. 16/644,016, mailed Feb. 29, 2024 (37 pages).
Non-Final Office Action for U.S. Appl. No. 16/644,027 mailed Apr. 8, 2022 (26 pages).
Final Rejection for U.S. Appl. No. 16/644,016 mailed May 18, 2022 (21 pages).

* cited by examiner 130
703
701

801
803

902

1002

1101
e
12 y
1208
$\delta_2$
1203
1204
$T_3$
$T_1$
1202
300
$T_2$
1201

COSMETIC APPLICATOR

TECHNICAL FIELD AND BACKGROUND

The present invention relates to applicators for applying a cosmetic composition to the eyelashes or eyebrows, having an applicator part made up of a core and a plurality of elements attached to the core, each element having a central part fitted onto the core and at least one application member carried by the central part.

DESCRIPTION OF THE RELATED ART

The U.S. Pat. No. 8,899,241 B2 discloses a first applicator of this type. The core is constituted for example by a metal hairpin folded on itself and twisted, or from a shaft of non-circular cross section, the central part being passed through by one or more openings with corresponding shapes.

The U.S. Pat. No. 9,591,916 B2 discloses further examples of applicators of this type, the central parts being in the form of disks that can be produced with complementary reliefs which allow them to be positioned with a mutually predefined angular orientation. The application members are constituted of simple spikes or, in a variant, of spikes that have short offshoots about a third of the way along their length. In further variants, the application members are in the form of tabs, the thickness of which decreases in the direction of the radially outer edge of the element, these tabs being flattened in one and the same plane as the central part. The tabs may be provided with concentric striations about the axis of the core, of small depth, or bosses or indentations of small size, forming a surface roughness.

There is a need to further improve applicators of this type, notably in order to have a good capacity for loading the eyelashes or eyebrows with cosmetic composition, while having satisfactory properties of combing and separating the eyelashes.

SUMMARY OF THE INVENTION

Exemplary embodiments of the invention aim to satisfy this need and relate to an applicator for applying a cosmetic composition to the eyelashes or eyebrows, comprising:

- a core,
- at least one element attached to the core, each element comprising a central part fitted onto the core and
  - at least one application member carried by the central part, this application member being hollow and comprising at least one cavity passing through it in one direction and having a closed or almost closed contour when viewed in this direction, and/or
  - at least two adjacent application members forming at least one almost closed cavity between one another.

Advantageously, the cosmetic composition intended to be applied to the eyelashes and/or eyebrows is a mascara composition. A mascara composition conventionally has a viscosity greater than 5 Pa·s, notably between 5 Pa·s and 50 Pa·s, at 25° C., in particular measured with the aid of a Rheomat RM100® machine.

Such a mascara composition conventionally comprises a solids content, generally in an amount greater than or equal to 35% by weight relative to the total weight of the composition, a pulverulent colorant, in particular one or more pigments, notably one or more metal oxides, for example one or more iron oxides, and advantageously a film-forming polymer. A mascara composition may also conventionally comprise one or more waxes, in a total amount of in particular between 5 and 40% by weight relative to the total weight of the composition.

In the scope of the present invention, the applicator is particularly suitable for applying a relative fluid mascara composition. This is because a mascara composition having a relatively low viscosity will be retained particularly well, notably by surface tension, within the cavity having a closed or almost closed contour in the application member or between two adjacent application members, while being able to be easily picked up by contact with an eyelash or eyebrow and to be deposited thereon, this bringing into contact causing the surface tension between the mascara composition and the cavity to be broken.

The invention makes use of the fact that said elements can be produced separately so as to form reliefs therebetween which would be difficult, if not impossible, to realize on conventional injection-molded brushes, in which the application members are molded in one piece of thermoplastic material with the core, on account of the problems associated with demolding.

In one particularly preferred embodiment, in accordance with the teaching of the document U.S. Pat. No. 8,899,241 B2 or its equivalent FR 2 900 319, the core has a longitudinal axis and each element is threaded onto the core along its longitudinal axis before the core is twisted, the core and the element, in particular the core and the central part of the element, being mechanically connected in order to substantially prevent the element from pivoting freely on the core.

Such a mechanical connection with no possibility of relative rotation of the core and the element(s) threaded onto the latter before twisting can be obtained by means of a core produced in the form of an elongate element that is made of plastically deformable material and has a non-circular (for example polygonal, such as square, rectangular, triangular, etc., oval, multilobed, etc.) cross section in the non-twisted state, said core being threaded through an orifice of complementary cross section provided in the central part of each of the elements.

In a variant, the core comprises two wires made of plastically deformable material, for example two metal wires, optionally joined together at one of their ends by being produced from a single wire folded into the form of a hairpin, and the mechanical connection with no possibility of relative rotation of the core and the element(s) threaded onto the latter before twisting is obtained by threading the wires of the core in the non-twisted state into two orifices, preferably with complementary shapes, provided in the central part of each of the elements.

The core carrying the element(s) is then twisted so as to obtain a helical spread of the application members along the longitudinal axis of the core. The expression "the core is twisted" means here that the core, carrying the element(s), is subjected to torsion, realized for example by imparting on one of its parts a rotational movement about the longitudinal axis of the core (for example in the clockwise direction), while the other parts of the core remain rotationally fixed, or are subjected to a movement in the opposite direction (for example in the counterclockwise direction). This torsional force is realized so as to impart a plastic deformation on the core, such that the latter takes on its twisted shape in a stable and definitive manner once this torsional force stops being exerted on it.

The present invention is not limited to just the above-described embodiments for ensuring the mechanical connection with no possibility of relative rotation between the core and the element, in particular between the core and the central part of the element, but rather extends to all technical equivalents known to a person skilled in the art for producing such a connection.

The cavity of the hollow application members according to the invention makes it possible to collect product by surface tension and thus to increase the autonomy of the applicator and/or to increase the loading capacity of the applicator, without otherwise losing any capacity for separating and combing the eyelashes. This cavity preferably has a greatest dimension of at least 0.2 mm, better still at least 0.5 mm. The application members can be produced easily with a shape suitable for separation and combing and in sufficient numbers to obtain a satisfactory makeup effect. The invention makes it possible to produce wide application members that are capable of being loaded with a relatively large amount of composition while retaining a certain amount of flexibility, if desired, by producing them with the aid of a strand of material which surrounds the cavity, this strand preferably being contained in a plane.

The strand of material can be given any shape depending on the desired characteristics, and notably a constant or non-constant cross section around the perimeter of the cavity. The strand of material can be given a shape that is narrower in places, if need be, in order to confer greater flexibility thereon. The strand has a cross section, notably of square shape, of for example between 0.04 and 1 $mm^2$ around at least a quarter of the perimeter of the cavity that it delimits, better still at least half the perimeter, or even three quarters or all thereof. The presence of the cavity gives the hollow application members greater flexibility in order to pass the wiping member with which the container from which the composition is taken is equipped.

The cross section may have a circular shape.

The strand of material can comprise at least a portion with a variable curvature.

The strand of material can comprise at least a slope discontinuity that forms an elbow. The greatest width of the, notably hollow, application members, measured perpendicularly to the elongation axis, is for example greater than or equal to 0.5 mm, being preferably between 0.5 and 5 mm, better still between 1 and 2 mm.

Preferably, the central part and the application members of an element are produced in one piece by molding thermoplastic material, notably from the same material. Each element which is mounted on the core can have between 4 and 24 application members.

The element may have hollow application members, the cavity of which has a closed contour, thereby helping to improve the mechanical integrity of the application member, since the latter can be can then be produced without a free strand of material.

It is thus possible to obtain application members which are both highly loadable with product and have a good capacity for combing and separating the eyelashes on account of their mechanical strength.

The fact that the applicator is produced with separate elements makes it possible to easily give the cavity of the hollow application members various shapes, and/or to form almost closed cavities of various shapes therebetween, the element being for example demolded along the axis of the central part, which is the general direction in which the core passes through the central part, this axis being able to be parallel to an axis along which the cavity passes through the application member. If need be, notably when the axis of the cavity is oriented perpendicularly to a radius, demolding can be carried out with elastic deformation of the application member.

The cavity formed by a hollow application member can also be almost closed, that is to say that the strand of material which defines the cavity is interrupted over a short distance instead of extending through a closed loop. This distance is less than or equal to 0.3 mm, better still less than or equal to 0.2 mm, even better still less than or equal to 0.1 mm.

It is also possible, and this can be combined with the presence of hollow application members, to produce almost closed cavities on the applicator part, where the composition can collect, by adjusting the shape of the application members and the closeness thereof. Here too, the invention makes use of the fact that the presence of elements initially separate from the core makes it possible to produce them with shapes that are otherwise difficult, if not impossible to mold on a conventional injection-molded brush. Almost closed cavities should be understood as meaning that the adjacent application members are close together, at a non-zero radial distance from the central part, by a distance less than or equal to 0.3 mm, better still less than or equal to 0.2 mm, even better still less than or equal to 0.1 mm. The spacing is for example measured at at least 0.5 mm from the central part. For example, the adjacent application members have a succession of pointed arches which proceed from the core and define teeth, two of which are sufficiently close together for an almost closed cavity to be formed between the two application members by the portion thereof which extends from the teeth closest to the central part.

In exemplary embodiments, the hollow application member has a strand of material extending through a complete loop. This strand of material has for example a substantially constant cross section around the majority of the perimeter of the loop, or even around the entire perimeter of the loop.

This loop can extend entirely at a distance from the central part, and this can have the advantage of forming a reserve of product at a location relatively far away from the core, for example more than 3 mm from the surface of the central part, this constituting a significant difference compared with brushes produced by injection-molding plastics material with simple spikes, the reserve of product then being closed at the base of the spikes in these known brushes and not at a significant radial distance from the core.

In exemplary embodiments, the loop forms an enlarged head for the application member and is joined to the central part by a leg, which is notably less wide than said head. This enlarged head can be given a harpoon shape for example, with the additional advantage of improving the catching of the eyelashes on the applicator and thus the capacity for the applicator to control the eyelashes, notably in order to curl them, in the manner desired by the user. The leg may be a single-strand leg or, in a variant, a multi-strand leg. The height of the leg can be greater than that of the head, the height being measured along the elongation axis of the application member, this axis being preferably radial. The presence of a single-strand leg can confer greater flexibility on the application member when this is desired.

In variant embodiments, the application member has a base and a head that are linked by a stem that is narrower than the base and the head, the cavity extending preferably continuously from the base to the head. Such variants make it possible to benefit both from a cavity that is suitable for collecting a relatively large amount of composition and from reliefs on the application member that increase the capacity of catching the eyelashes and/or aim to further increase the loading of the application member with composition, at a predefined distance from the core.

In variant embodiments, the hollow application member has a strand of material extending through an incomplete loop closed by the central part. This can make it possible to give the application member a wider base, and thus greater stability, and to extend the cavity as far as the central part.

When the cavity of the hollow application member extends over the majority of the radial dimension of the application member, notably over more or less all of its height, apart from the thickness of the standard material forming the loop, this tends to increase the amount of product which becomes housed in the application member and makes it possible to benefit from a reserve of product over more or less the entire height of the application member.

The width of the cavity, measured in the circumferential direction, that is to say perpendicularly to a median radius, may be constant or variable. When it varies, its variation can be chosen so as to collect more or less product at the desired distance from the core, depending on the desired makeup effect.

For example, the application member has a base and a head that are linked by a stem that is narrower than the base and the head. Product can thus collect in the cavity inside the base, the stem and the head, with less product collected at the stem within the cavity.

The head and the base may form between one another at least one groove that is open in the circumferential direction, being able to contribute toward the catching of the eyelashes, and also making it possible to collect product at a distance from the core on the application member, outside the cavity.

This groove may have a substantially flat bottom, notably oriented substantially radially, and facing edges that converge toward the opening of the groove, this being able to improve the retention of the composition in the groove.

In variant embodiments, the hollow application member is toothed at its periphery. The teeth are for example formed by a succession of pointed arches that are concave toward the outside. The application member is for example in the overall shape of a holly leaf. The teeth that are present at the periphery of the application member can promote the catching of the eyelashes and also form reliefs that are suitable for collecting product at a (radial) distance from the central part of the element.

In variant embodiments, the application member has two lateral arches linked by a top arch, the lateral arches and the top arch preferably forming teeth at their meeting point. These teeth can help to comb and separate the eyelashes. The top arch can be concave toward the outside, in which case the concavity formed by the top arch makes it possible to collect product at a distance from the central part. The lateral arches can be concave in the opposite direction to the cavity formed therebetween. The application member can have a shape which widens toward the outside, away from the central part.

In variant embodiments, the hollow application member is multilobed at its periphery, the lobes being for example formed by a succession of pointed arches that are convex toward the outside. The application member can notably in this case be in the shape of an arrowhead.

An applicator according to the invention can thus have one or more of the following characteristics, considered in isolation or in combination:

- the applicator may have at least one hollow application member, the cavity having a closed contour;
- the hollow application member may have a strand of material extending through a complete loop;
- the loop may extend entirely at a non-zero distance from the central part;
- the loop may form an enlarged head that is joined to the central part by a leg that is less wide than the head;
- the head may have the overall shape of a harpoon;
- almost closed cavities may be formed between two consecutive application members, the distance (e) between the heads being less than or equal to 0.3 mm, better still less than or equal to 0.2 mm, even better still less than or equal to 0.1 mm;
- the hollow application member may have a base and a head that are linked by a stem that is narrower than the base and the head;
- the head and the base may form between one another at least one groove that is open in the circumferential direction, preferably having facing edges that converge toward one another away from the bottom of the groove;
- the hollow application member may be toothed at its periphery;
- the teeth may be formed by a succession of pointed arches that are concave toward the outside;
- almost closed cavities may be formed between the teeth of two consecutive application members, the distance (e) between these teeth being less than or equal to 0.3 mm, better still less than or equal to 0.2 mm, even better still less than or equal to 0.1 mm;
- the hollow application member may widen toward the outside, being formed by two lateral arches linked by a top arch, the lateral and top arches forming teeth at their meeting point;
- the top arch may be concave toward the outside;
- almost closed cavities may be formed between two consecutive application members, the distance (e) between the teeth being less than or equal to 0.3 mm, better still less than or equal to 0.2 mm, even better still less than or equal to 0.1 mm;
- the hollow application member may be multilobed at its periphery;
- the lobes may be formed by a succession of pointed arches that are convex toward the outside;
- the application member may be in the shape of an arrowhead;
- the hollow application member may have a strand of material extending through an incomplete loop closed by the central part;
- the hollow application member may have a radially outer edge that is convex toward the outside;
- the application members may meet at their base;
- at least one element may have, in the circumferential direction, an alternation of hollow application members and solid application members;
- the spacing between the application members at their base may be greatest at their base;
- the spacing between the application members may be smallest at their base;
- the elongation axes (Y) of the application members may be coplanar;
- at least one application member of an element may be flattened in a plane, and notably each application member may be flattened in a flattening plane common to all the application members of the element;
- the application members of an element may have their flattening plane oriented in a plane containing the axis (X) of the central part;
- the hollow application member may have a shape that is symmetric with respect to a median plane containing the elongation axis (Y) of the application member and perpendicular to the flattening plane.

Exemplary embodiments of the present invention relate a packaging and application device comprising:

a container containing the composition to be applied, an applicator according to the invention.

Further embodiments of the invention relate to a method for the cosmetic treatment of the eyelashes and/or eyebrows, notably for making them up, comprising the step of applying a cosmetic composition to the eyelashes with the aid of an applicator according to the invention.

BRIEF DESCRIPTION OF THE DRAWINGS

The invention may be better understood from reading the following detailed description of non-limiting exemplary embodiments thereof and from examining the appended drawing, in which.

DETAILED DESCRIPTION

Figure 1:
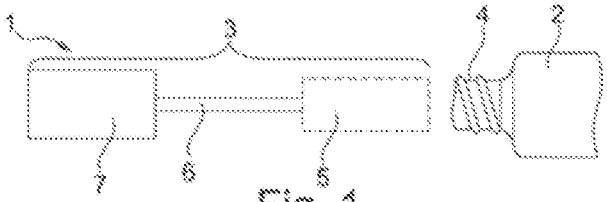
FIG. 1 shows a schematic and partial view of an example of a packaging and application device according to the invention.

The packaging and application device 1 shown schematically and partially in FIG. 1 has a container 2 containing the composition to be applied and an applicator 3 for applying this composition.

The container 2 has a body which is provided for example, as illustrated, with a threaded neck 4 to which the applicator 3 can be fastened when the device 1 is not being used.

A wiping member (not visible in the figure) is secured in the neck of the container, in the usual manner. It may be a flexible lip with a conical, wavy or other shape.

The applicator 3 comprises an applicator part 5 which is used for applying the composition, this applicator part 5 being mounted at one end of a stem 6, the other end of which is carried by a gripping member 7 that also constitutes, in the example in question, a closure member for the container 2, being designed to be fastened to the neck 4.

The composition which is applied may be constituted by any cosmetic product intended for making up or for caring for the eyelashes and/or eyebrows. Preferably, it is mascara. The composition may notably include pigments, such as iron oxides, dispersed in an aqueous or anhydrous medium. The capacity of the container is preferably between 5 and 30 ml.

Figure 2:
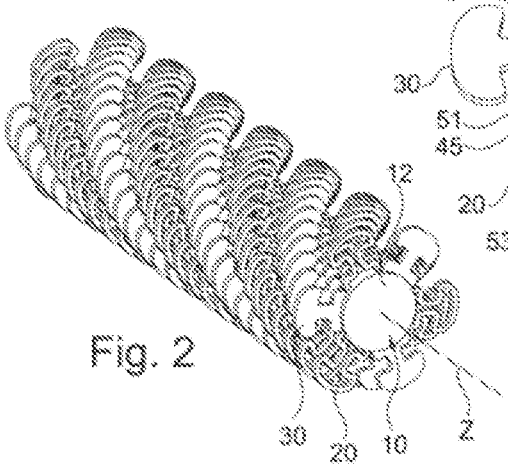
FIG. 2 shows the applicator part of an example of an applicator produced in accordance with the invention, on its own.
Figure 3:
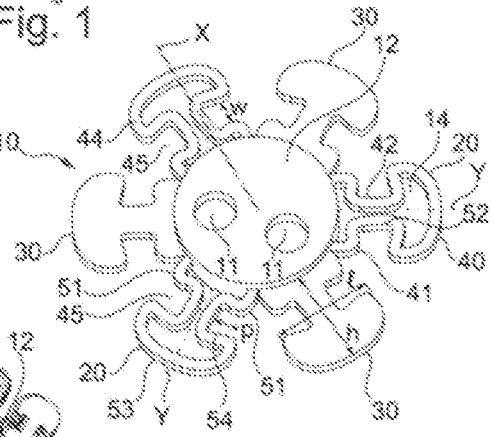
FIG. 3 shows an element used to produce the applicator part shown in FIG. 2, on its own.

FIG. 2 shows an example of an applicator part 5 produced from individual elements 10, one of which has been shown on its own in FIG. 3.

The applicator part 5 is preferably produced in accordance with the teaching of the U.S. Pat. No. 8,899,241 B1, as described below. The elements 10 are thus mounted on a core 9 that holds them in a stacked manner and secures them relative to one another. This core 9 is for example a twisted core, produced from a metal wire folded into the form of a hairpin, as illustrated in FIG. 4.

Figure 4:
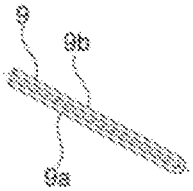
FIG. 4 shows an example of a core on which the elements can be mounted, the core being shown before the mounting of the elements and twisting.

In a variant, the core may be constituted by two separate metal wires that are positioned in a substantially parallel manner like the arms of the hairpin illustrated in FIG. 4, onto which the elements 10 are threaded and which are then twisted.

The elements 10 have holes 11, which are shown schematically in FIG. 3, for the arms 9*a* and 9*b* of the core to pass through before the latter is twisted.

For the sake of clarity of the drawing, the core 9 has not been shown in FIG. 2, and the holes 11 passing through the central part 12 are only shown in FIG. 3.

In the example in question, the elements 10 are identical, but it would not constitute a departure from the scope of the present invention if elements 10 of different shapes were stacked on the core 9 within the applicator part 5.

As can be seen in FIG. 3, each element 10 has hollow application members 20 which engage with the eyelashes or eyebrows while the applicator 3 is being used. In the example in question, these hollow application members 20 alternate circumferentially with solid application members 30.

The application elements 20 and 30 have, in this example, the same exterior shape, but it would not constitute a departure from the scope of the present invention if the exterior shapes were different.

The central part 12 is in the form of a flattened disk, the holes 11 for the arms 9*a*, 9*b* of the core 9 to pass through being disposed symmetrically relative to an axis X of the element 10, which may be an axis of symmetry for the central part 12.

In the example illustrated, the element 10 has three hollow application members 20 which alternate with three solid application members 30, the hollow application members 20 being disposed at 120 degrees to one another about the axis X of the element 10.

The application members 20 or 30 have an enlarged head 40 linked to a base 41 by a stem 42 that is less wide than the head and the base. The head 40 forms with the base 41, on the outside, a groove 45 on each side of the elongation axis Y of the application member 20. The head is wider than the base 41.

This elongation axis Y is, in the example illustrated, an axis of symmetry for the application member, and coincides with a radius.

The surface of the central part 12, to which the application members are joined, may be in the shape of a cylinder of revolution about the axis X, but further shapes are possible.

In the example illustrated, the application members 20 and 30 each have a flattened shape in a plane which is coincident with the flattening plane of the central part 12, this plane being perpendicular to the axis X and to the axis Z of the applicator part 5.

The application members 20 and 30 substantially meet at their base, where they are joined to the central part 12.

The application members 20 are formed by a strand of material 44 which extends through a loop that is closed by the central part 12. More particularly, this strand of material 44 is joined to the central part 12, forming a first elbow 51, which forms one of the sides of the enlarged base 41. The strand 44 continues beyond the elbow 51 with a U-shaped portion 52 that defines the groove 45 on one side of the application member 20 and then continues in the form of an arch 53, convex toward the outside, which forms the top of the enlarged head 40 of the application member 20.

The enlarged head 40 has, on the opposite side from the arch 53, edges 54 which are oriented toward the axis Y and toward the arch 53. The groove 45 has edges that converge slightly toward the opening thereof, the bottom of the groove 45 being substantially flat for example, as illustrated.

The fact that the groove 45 is delimited by edges which converge away from the bottom thereof further improves the retention of the composition within said groove by the surface tension effect.

Each application member 20 or 30 has a relatively squat shape, with a height h, measured between the vertex of the application member and the central part, which is substantially of the same order of magnitude as the width l of the application member, measured perpendicularly to the elongation axis Y. For example, $0.5\ h \leq l \leq 2\ h$. For example, $1\ mm < l < 6\ mm$ and $2\ mm < h < 8\ mm$.

The cavity 14 defined inside the strand of material 44 makes it possible to collect the composition within the applicator part 5 in spite of the passage through the wiping member on exiting the container 2.

Product can also collect in the grooves 45 formed between the head and the base of the application members 20 and 30, this collection of composition taking place at a non-zero radial distance from the central part 12. It is thus easier for the eyelashes and eyebrows to access the composition, since they do not have to be introduced as far as the central part 12 to be loaded with composition.

The protruding parts formed by the lateral ends of the enlarged heads are suitable for catching the eyelashes, and this can improve the controlling thereof by the applicator part, in order for example to curl them or spread the composition over the surface thereof.

The relatively wide base of the application members 20 and 30 gives them good stability with respect to forces which can be exerted while the applicator part 5 is being used, notably on passing through the wiping member or for applying the composition to the eyelashes and eyebrows. The cavity 14 helps to confer flexibility for passing through the wiping member.

In order to produce the applicator parts 2, the elements 10 are threaded onto the core 9 and then the latter is twisted, as per the teaching of the U.S. Pat. No. 8,899,241 B2. The number of elements 10 is for example between 2 and 100, better still between 5 and 15.

In order to manufacture the elements 10, they can be molded in a suitable mold such that demolding takes place along the axis X.

In such a case, the presence of the cavity 14 within the hollow application elements 20 does not hamper demolding in any way. In general, any thermoplastic material can be used to mold the elements 10, regardless of the shape of the central part 12 and of the application members joined thereto. It is possible notably to use a polyolefin or a thermoplastic elastomer, for example of the SEBS type.

It is also possible to produce the element 10 from a non-thermoplastic material, for example a metal or ceramic material.

During the twisting of the core, the elements 10 can undergo rotation relative to one another, such that a progressive angular offset is created between the elements, along the core, this being able, if appropriate, to create helical furrows in the applicator part 5.

In a variant, when the elements 10 are mounted on a non-twisted core, for example one that is constituted by a shaft of non-circular cross section, the central parts 12 have an opening with a corresponding shape, so as to allow the central parts to be mounted on the shaft without rotation relative thereto. The elements 10 can be disposed on the core with their final orientation, with a possible angular offset of each element with respect to its neighbors, such that the hollow application members 20 of two successive elements 10 are angularly offset through 30 degrees, meaning that an application member 20 or 30 is positioned angularly in the gap that exists between two application members of the neighboring element.

If appropriate, it is possible to produce the central parts 12 with complementary reliefs which cooperate so as to make it easier to position one element 10 in a predefined angular position about the longitudinal axis of the core relative to the adjacent elements 10.

The depth p of the groove 45 is for example greater than or equal to 0.2 mm and the width w of the opening of the groove is for example between 0.2 and 3 mm.

The strand of material 44 can have a cross section which is substantially constant around the entire contour of the application member 20, between its ends that are joined to the central part 12. The cross section of the strand 44 is for example around 0.25 $mm^2$.

Variant embodiments of application members and elements 10 having a hollow application members 20 will now be described with reference to FIGS. 5 to 22.

Figure 5:
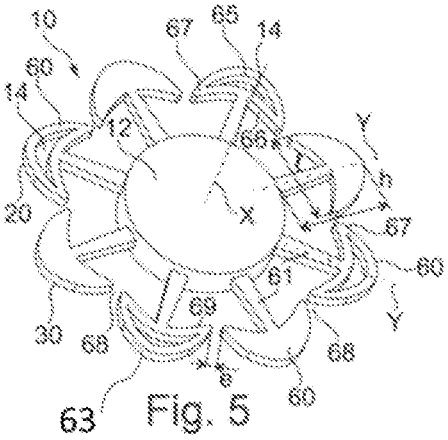
FIG. 5 is a view similar to FIG. 3 of a variant embodiment.
Figure 6:
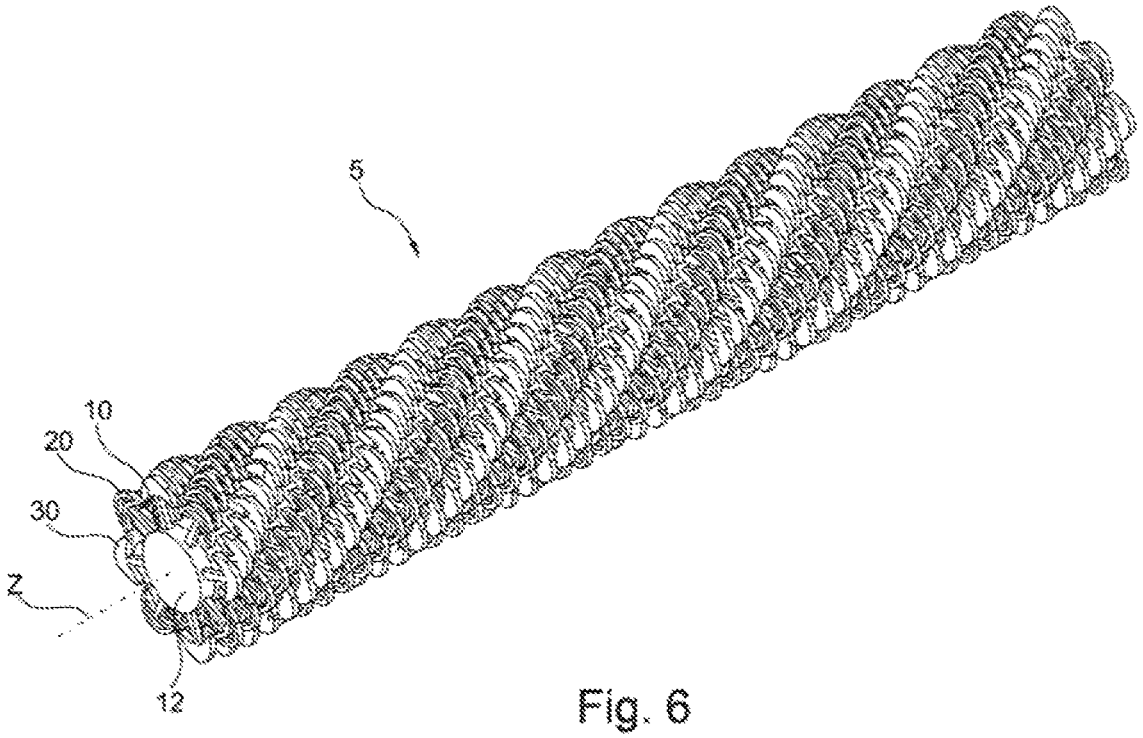
FIG. 6 shows the applicator parts produced with the elements in FIG. 5.

In the variant in FIGS. 5 and 6, each element 10 has an alternation of hollow application members 20 and solid application members 30, there being four hollow application members 20 in the example in question, which are disposed at 90 degrees to one another.

The cavity 14 of each hollow application member 20 is formed by a strand of material 63 which describes a closed curve constituting an enlarged head 60, this loop being joined to the central part 12 by a leg 61.

In the example illustrated, the enlarged head 60 has the overall shape of a harpoon with a top arch 65, which has a substantially parabolic shape that is convex toward the outside, and a bottom arch 66, which is concave toward the central part 12 and has less of a curvature than the top arch 65.

The cavity 14 has a radial dimension which is thus at its maximum on the elongation axis Y and which decreases towards the meeting point between the arches 65 and 66.

At this meeting point, the enlarged head 60 defines teeth 65 which are oriented in a direction away from the axis Y and toward the central part, this orientation helping to catch more of the eyelashes which are introduced into the applicator part 5.

In the example illustrated, the distance e between the enlarged heads 60 of two adjacent application members 20, 30 on the element 10 is relatively small and less than the distance between the legs 61 at their base. The enlarged heads 60 are thus relatively close together. This distance e may be between 0.1 and 0.3 mm, being large enough to allow an eyelash to pass into the space between two legs 61 under the enlarged heads 60.

When the spacing e is sufficiently small, that is to say less than or equal to 0.3 mm, better still less than or equal to 0.2 mm, even better still less than or equal to 0.1 mm, another cavity 69, which is almost closed, where the composition can also collect by surface tension, is formed between the application members 20 and 30. This almost closed cavity 69 extends as far as the central part 12 in the example in question.

In the same way as for the example in FIG. 3, it is possible to have a height h and a width l of the application member which satisfy the relationship $0.5\ h \leq l \leq 2\ h$.

FIG. 6 shows that the elements 10 can be angularly offset on account of the twisting of the core.

A variant embodiment of the applicator part 5 and of the elements 10 with which the latter is produced will now be described with reference to FIGS. 7 and 8.

Figure 7:
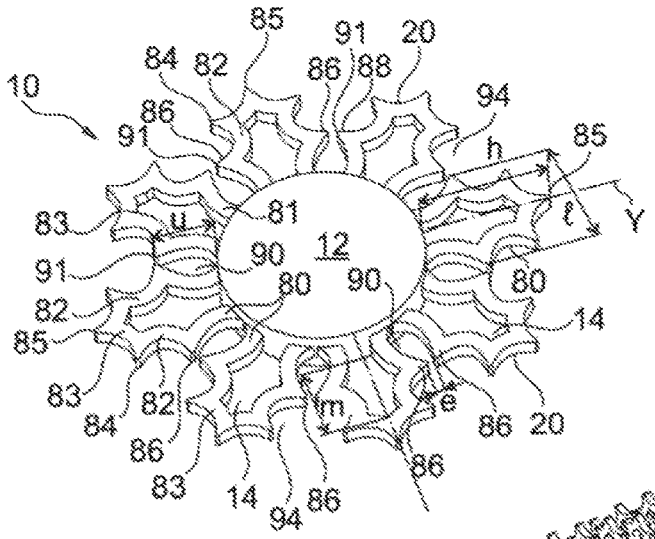
FIG. 7 is a view similar to FIG. 3 of a variant embodiment.

In the example in FIG. 7, the element 10 only has hollow application members 20, unlike the examples in FIGS. 3 and 5, where there is an alternation of application members of different natures in the circumferential direction.

All of the application members 20 are identical and each have a toothed shape. The cavities 14 are delimited by a strand of material 80 which describes a succession of pointed arches, which are concave toward the outside, teeth being formed at the meeting point between two arches. More particularly, in the example illustrated, the strand of material 80 describes, starting from the central part 12, a first pointed arch 81, which is joined to a second arch 82, forming a first tooth 86, this second arch 82 itself being joined to a third arch 83, forming a tooth 84.

Each application member 20 has a shape that is symmetric with respect to its elongation axis Y.

At their meeting point, the two arches 83 form a tooth 85, which defines the vertex of the hollow application member 20 and is situated on the elongation axis Y.

Each application member 20 thus has the overall shape of a holly leaf. In this example, the cavity 14 extends over substantially the entire height h of the application member 20, less the thickness taken up by the strand of material 80. The height m of the cavity, measured along the elongation axis Y, that is to say along a radius in the example in question, is thus greater than or equal to half the height h. There is for example the following relationship between l and h 0.5 h≤l≤2 h.

FIG. 7 shows that the gap e which exists between two adjacent application members, at the teeth 86, is relatively small and for example less than or equal to 0.3 mm, and may notably be between 0.1 and 0.3 mm.

In the example illustrated, the application members 20 substantially meet at their base, where the strands of material 80 are joined to the central part 12. The fact that the teeth 86 of the adjacent application members are relatively close together makes it possible to form, between the first arches 81 of two adjacent application members, reserves of product in a relatively confined space 90 which only communicates with the outside through a relatively narrow opening 91, of width e. The space 90 constitutes an almost closed cavity within the meaning of the invention, when the width e is less than or equal to 0.3 mm, better still less than or equal to 0.2 mm, even better still less than or equal to 0.1 mm.

The arches 82 which extend on either side of this narrow opening 91 define a product collection surface at a non-zero distance from the central part 12. The user thus has a reserve of product in this space 94, where the eyelashes can be introduced, while benefiting from teeth formed at the meeting point between the different arches in order to grip the eyelashes.

All of the concavities formed by the different arches form a corresponding number of indentations in which product can collect, thereby increasing the loading capacity of the applicator part 5.

Figure 8:
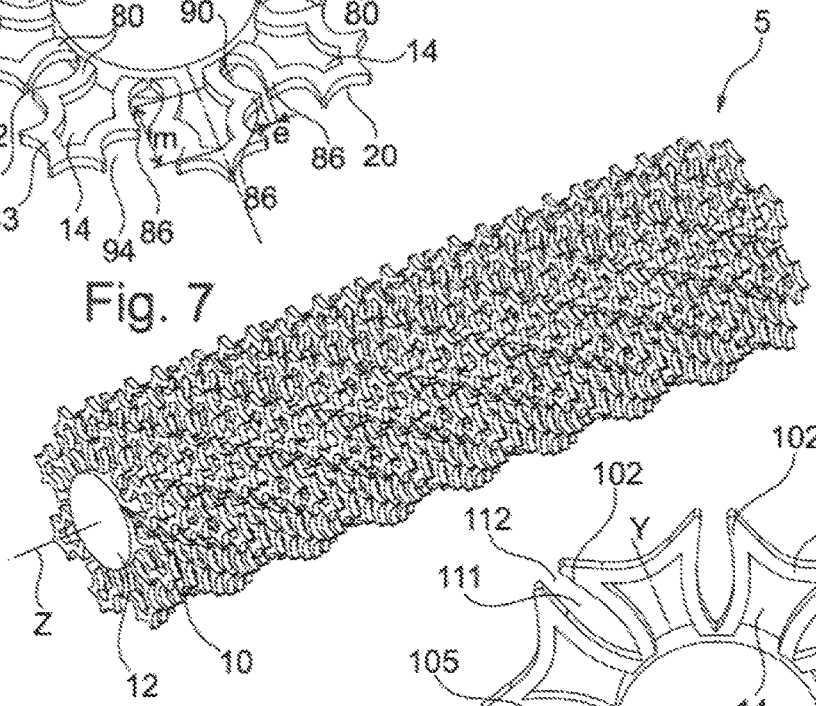
FIG. 8 shows the applicator parts produced with the elements in FIG. 7.

FIG. 8 shows that the elements 10 can be angularly offset on account of the twisting of the core.

A variant embodiment of the applicator part 5 will now be described with reference to FIGS. 9 and 10.

In this example, the element 10 only has hollow application members 20 that define a corresponding number of cavities 14.

Each application member 20 is formed by two lateral arches 100 that are joined at their distal end by a top arch 101, the lateral arches 100 and the top arch 101 being concave toward the outside. The arches 100 and 101 form teeth 102 at their meeting points. The application member 20 is formed by a strand of material 105.

The product can collect in the concavity of the top arch 101, the bottom of which is set back from the vertex of the teeth 102 along the elongate axis Y. Product can also collect in the cavity 14 formed by the strand of material 105. The facing lateral arches 100 of two adjacent application members 20 define a space 111 between one another, in which product can also collect. This space communicates with the outside through a narrow opening 112, this opening 112 leading out between the two teeth 102 of the two adjacent application members 20.

The fact that the opening 112 is narrow improves the retention of product between the hollow application members 20.

Figure 9:
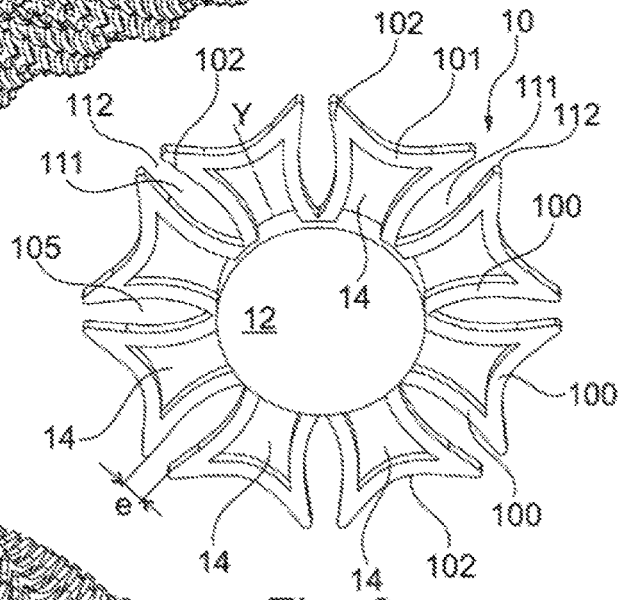
FIG. 9 is a view similar to FIG. 3 of a variant embodiment.

The application members 20 of the example in FIG. 9 thus make it possible to collect product in the cavity 14, and also in the recess of the top arch 101.

The teeth 102 favor the catching of the eyelashes on account of their oblique orientation relative to the elongation axis Y. Finally, the relatively small spacing between the adjacent application members 20 also helps the eyelashes to catch, the latter being able to be introduced into the space 111.

In the example illustrated, the lateral arches 100 of two adjacent application members meet at their base. The number of application members 20 is equal to eight.

Figure 10:
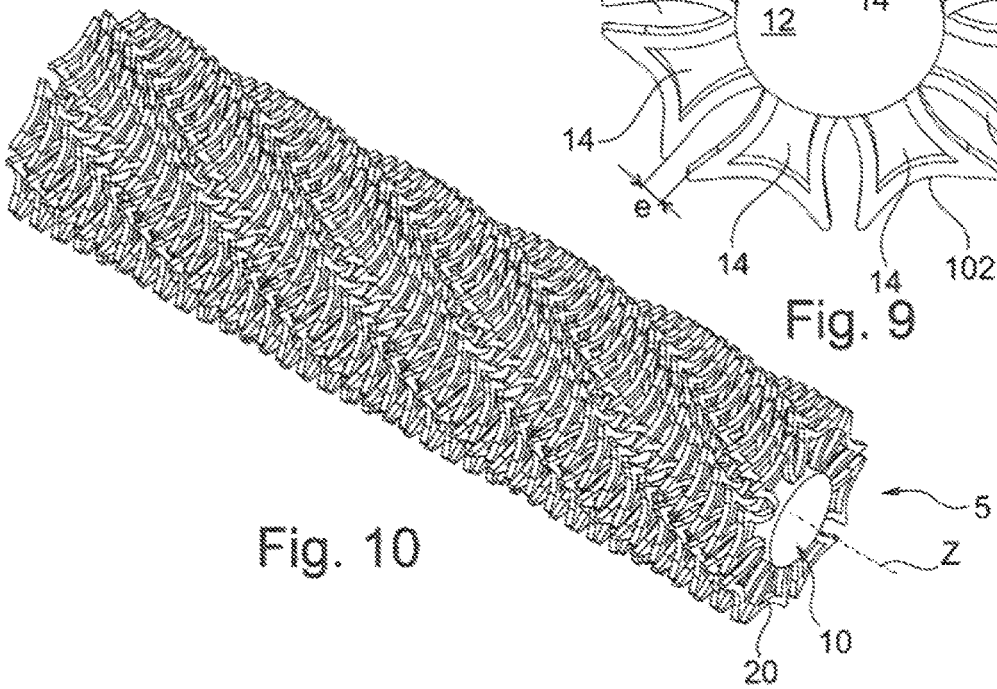
FIG. 10 shows the applicator parts produced with the elements in FIG. 9.

As illustrated in FIG. 10, the elements 10 can be angularly offset on account of the twisting of the core.

Figure 11:
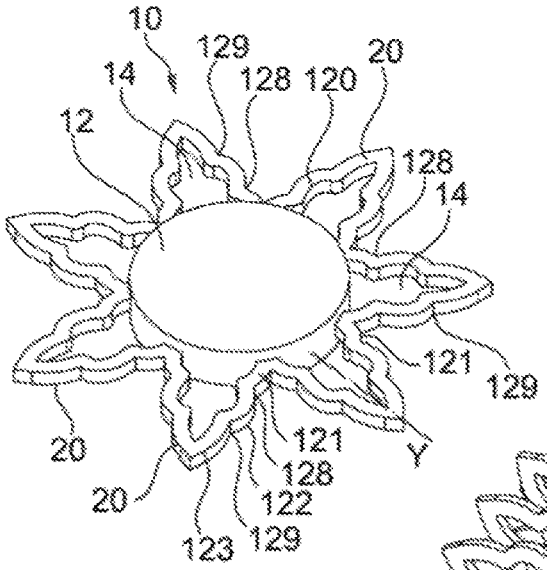
FIG. 11 is a view similar to FIG. 3 of a variant embodiment.
Figure 12:
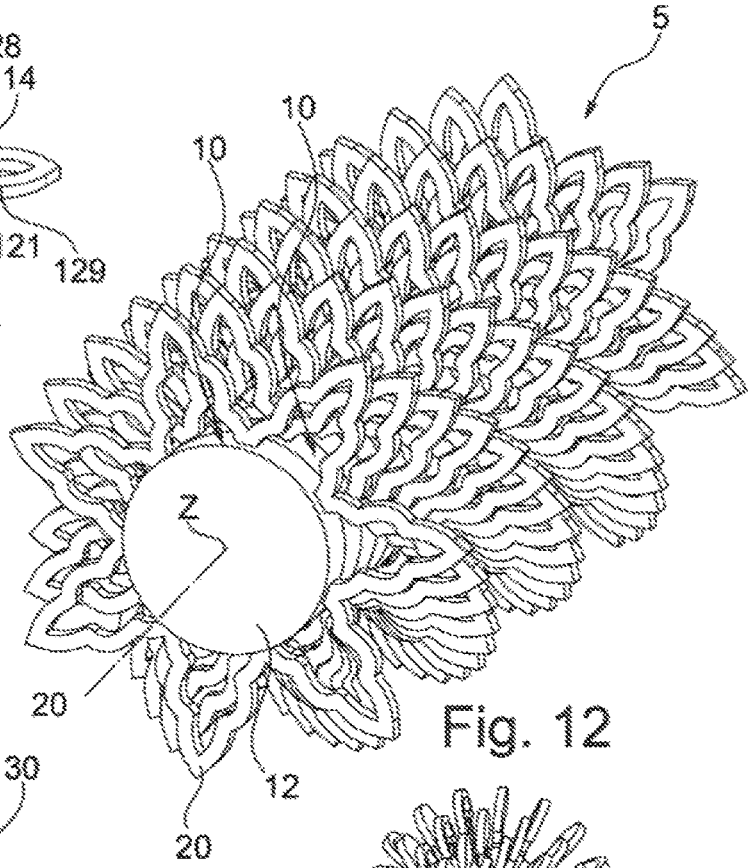
FIG. 12 shows the applicator parts produced with the elements in FIG. 11.

In the example in FIGS. 11 and 12, the hollow application members 20 have the overall shape of an arrowhead, with a strand of material 120 which has a succession of pointed arches that are convex toward the outside.

The application members 20 each have a shape that is symmetric with respect to their respective elongation axis Y. The strand of material successively describes, starting from the central part 12, a first arch 121, a second arch 122 and a third arch 123. The two arches 123 meet, forming a tooth at the vertex of the application member 20.

The arches 121 and 122 form, at their meeting point, away from the cavity 14, a recess 128 which can accommodate the composition. The same goes for the arches 122 and 123, which define a recess 129 at their meeting point.

In the example in FIG. 11, the hollow application members 20 meet at their base.

The elements 10 can be angularly offset on account of the twisting of the core.

In the examples which have just been described with reference to FIGS. 3 to 12, the hollow application members 20 each have a flattened shape in the flattening plane of the central part 12, and have a thickness, measured along the axis X of the central part 12, which is less than or equal to the thickness of the latter. The application members 20 can be given a different orientation without departing from the scope of the present invention, as will now be described with reference to FIGS. 13 to 22.

In the examples in these figures, each element 10 has a central part 12 that is thicker than in the above-described examples, and the hollow application members 20 are each in a form flattened in a plane which contains a radius and the axis X of the central part 12.

Figure 13:
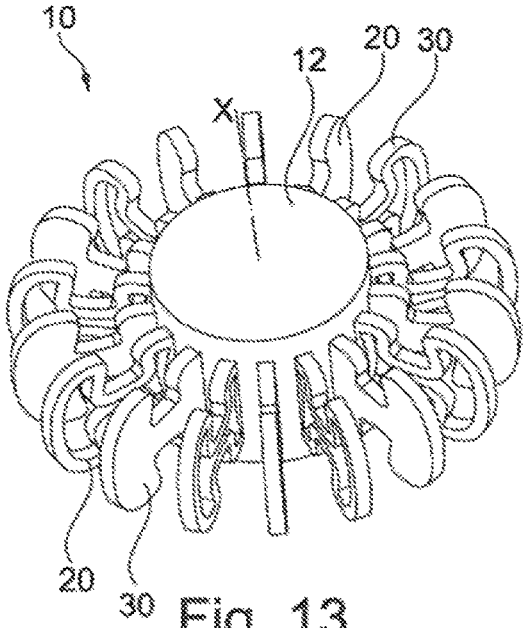
FIG. 13 is a view similar to FIG. 3 of a variant embodiment.
Figure 14:
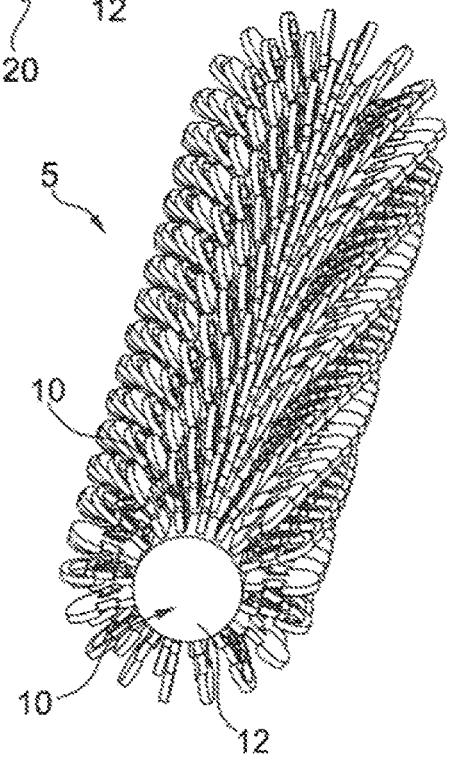
FIG. 14 shows the applicator parts produced with the elements in FIG. 13.

In the example in FIGS. 13 and 14, the elements 10 each have an alternation of hollow application members 20 and solid application members 30 with the same shape as those in the example in FIGS. 2 and 3.

However, in this example, the application members are more numerous and do not meet at their base, the spacing between two consecutive application members in the circumferential direction being for example greater than the thickness of one application member.

The element 10 has for example 18 application members, half of which are hollow.

FIG. 14 illustrates the angular offset of the elements 10 from one element 10 to the next on account of the twisting of the core.

Figure 15:
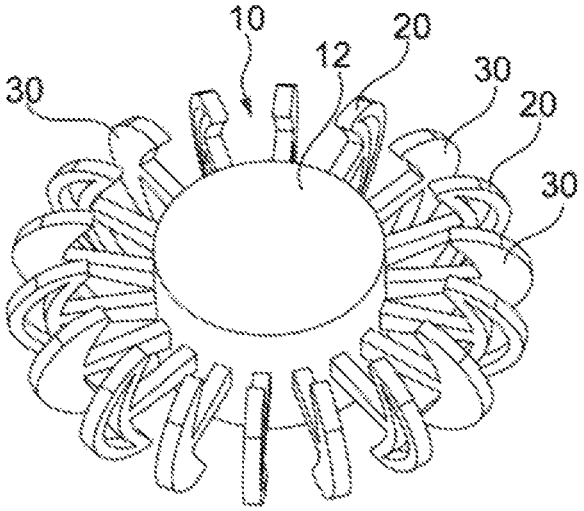
FIG. 15 is a view similar to FIG. 3 of a variant embodiment.
Figure 16:
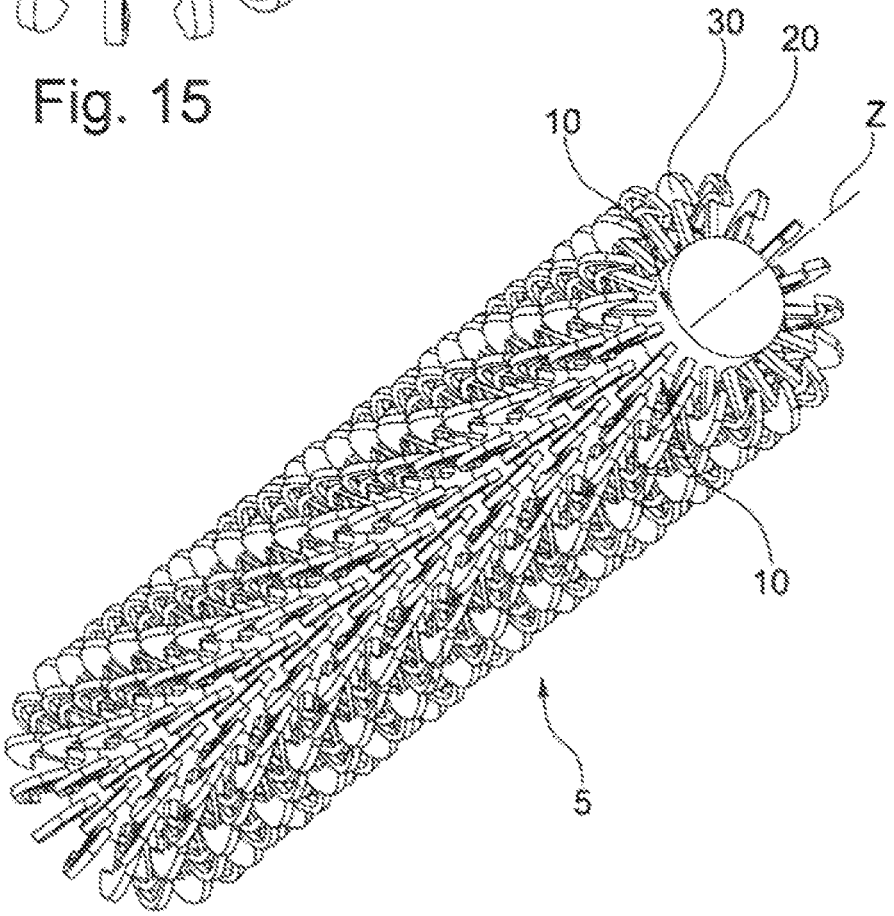
FIG. 16 shows the applicator parts produced with the elements in FIG. 15.

In the example in FIGS. 15 and 16, the application members 20 and 30 are identical to those in the example in FIGS. 5 and 6. The disposition thereof on the central part 12 is identical to that in the example in FIG. 13.

Figure 17:
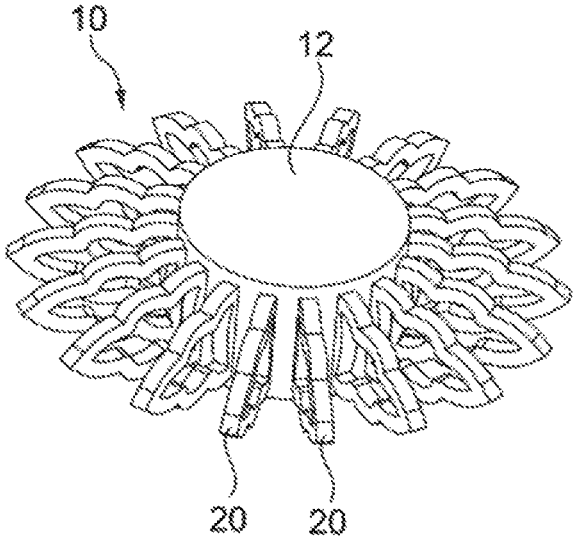
FIG. 17 is a view similar to FIG. 3 of a variant embodiment.
Figure 18:
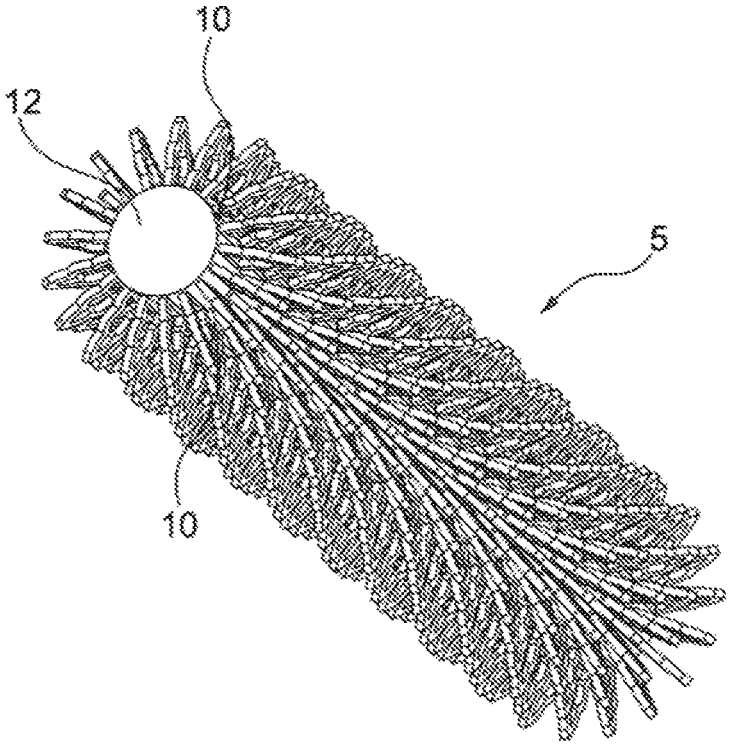
FIG. 18 shows the applicator parts produced with the elements in FIG. 17.

In the example in FIGS. 17 and 18, the application members 20 are identical to those in the example in FIGS. 11 and 12. The disposition thereof on the central part 12 is identical to that in the example in FIG. 13.

Figure 19:
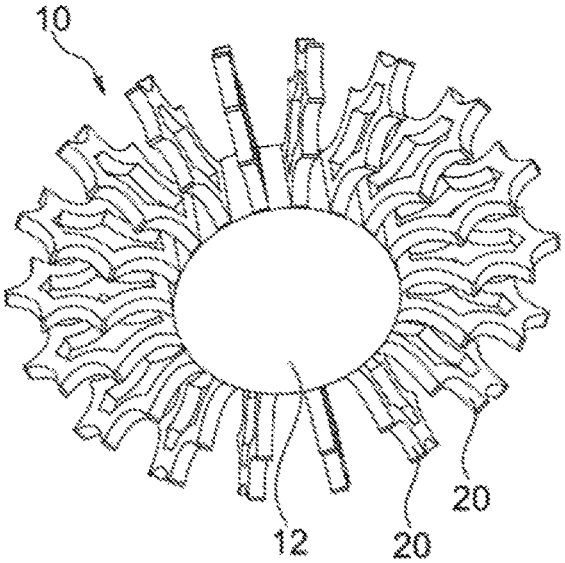
FIG. 19 is a view similar to FIG. 3 of a variant embodiment.
Figure 20:
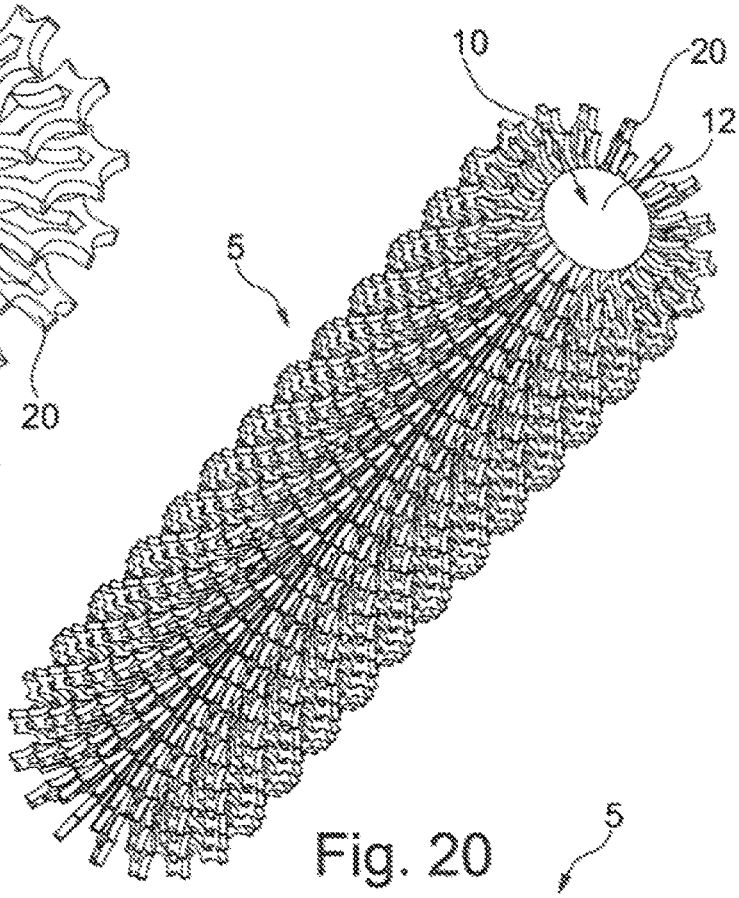
FIG. 20 shows the applicator parts produced with the elements in FIG. 19.

In the example in FIGS. 19 and 20, the application members 20 are identical to those in the example in FIGS. 7 and 8. The disposition thereof on the central part 12 is identical to that in the example in FIG. 13.

Figure 21:
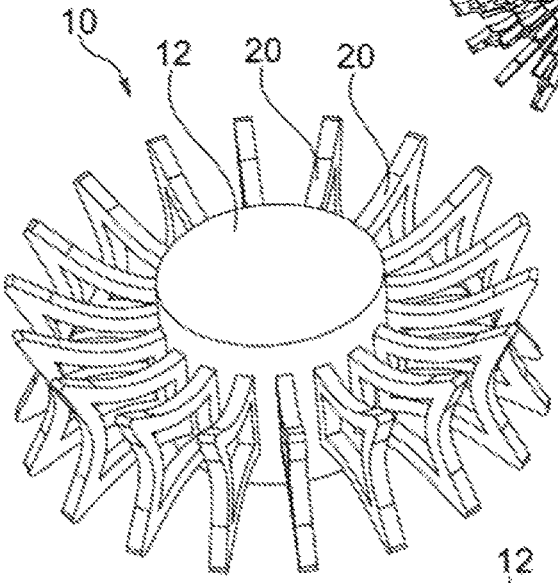
FIG. 21 is a view similar to FIG. 3 of a variant embodiment.
Figure 22:
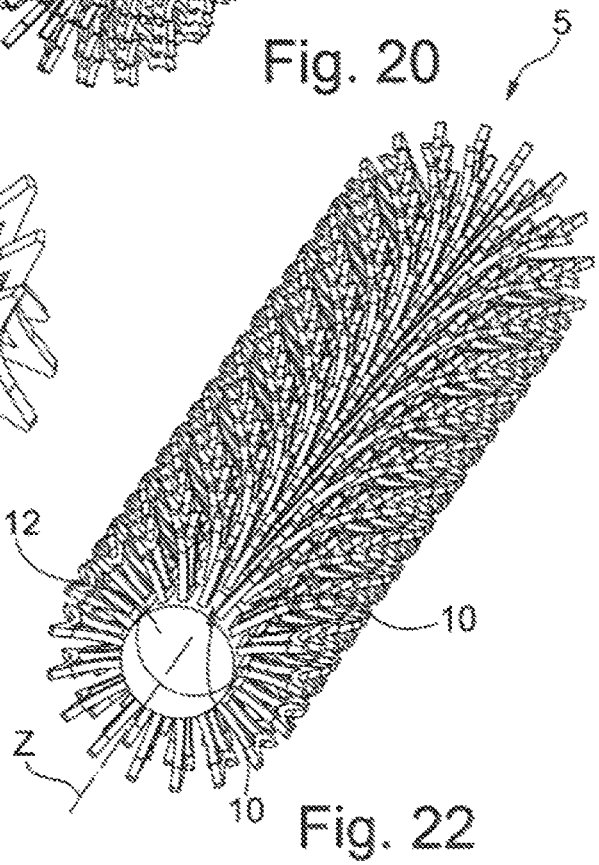
FIG. 22 shows the applicator parts produced with the elements in FIG. 21.

In the example in FIGS. 21 and 22, the application members 20 are identical to those in the example in FIGS. 9 and 10. The disposition thereof on the central part 12 is identical to that in the example in FIG. 13.

Of course, the invention is not limited to the examples that have just been described.

For example, the hollow application members can be given yet other shapes, and notably they can be produced with at least one bridge of material on the inside to form two interior cavities.

Figure 3A:
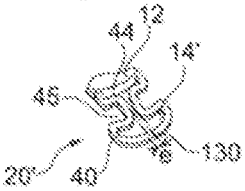

In the examples which have just been described, the hollow application members define closed cavities. It is possible to produce the hollow application members with almost closed cavities. By way of example, FIG. 3A shows an example of such a hollow application member 20, the outer contour of which is substantially identical to that of a hollow application member 20 of the example in FIG. 3 apart from an interruption 130 to the strand of material 44, this interruption having a width e less than or equal to 0.3 mm, better still less than or equal to 0.2 mm, even better still less than or equal to 0.1 mm.

An almost closed cavity can have the advantage of allowing eyelashes to pass through the interruption 130 and/or to confer greater flexibility on wiping.

In the example illustrated, the interruption 130 is positioned at the vertex of the application member, but could be positioned elsewhere, for example at the connection to the central part 12. This is for example the case in the examples displayed in FIGS. 35 to 47. The interruption 130 could be also positioned at a non-zero distance from the central part 12, between the central part 12 and the vertex of the application member as illustrated in FIGS. 56 and 57.

Reference is now made to FIGS. 35 to 47.

As illustrated, the cavity 14 of the hollow application member 20 is formed by a strand of material 300 which describes an almost closed loop, this loop being joined to the central part 12 by a leg 301.

Figure 35:
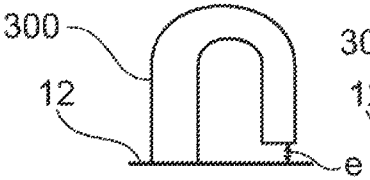
FIG. 35 shows a variant embodiment of an application member of the applicator

As illustrated in FIG. 35, the strand of material 300 has a substantially constant cross section around the entire perimeter of the loop. In a variant, it may have a non-constant cross section. For example, a section that tapers towards the free end of the loop, as displayed in FIG. 36.

Figure 37:
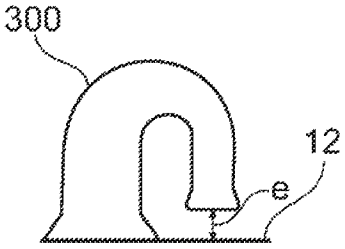
FIG. 37 shows a variant embodiment of the application member.
Figure 36:
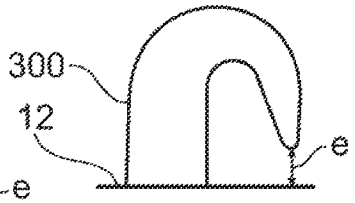
FIG. 36 shows a variant embodiment of the application member.
Figure 47:
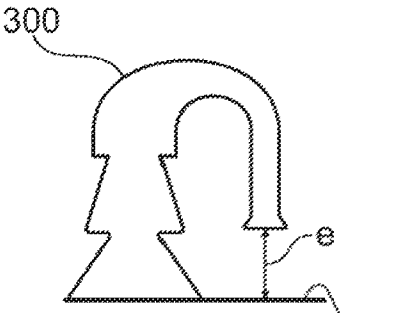
FIG. 47 shows a variant embodiment of the application member.
Figures 48, 49, 50, 51, 52, 53, 54, 55, 56, 57, 58, 59, 60:
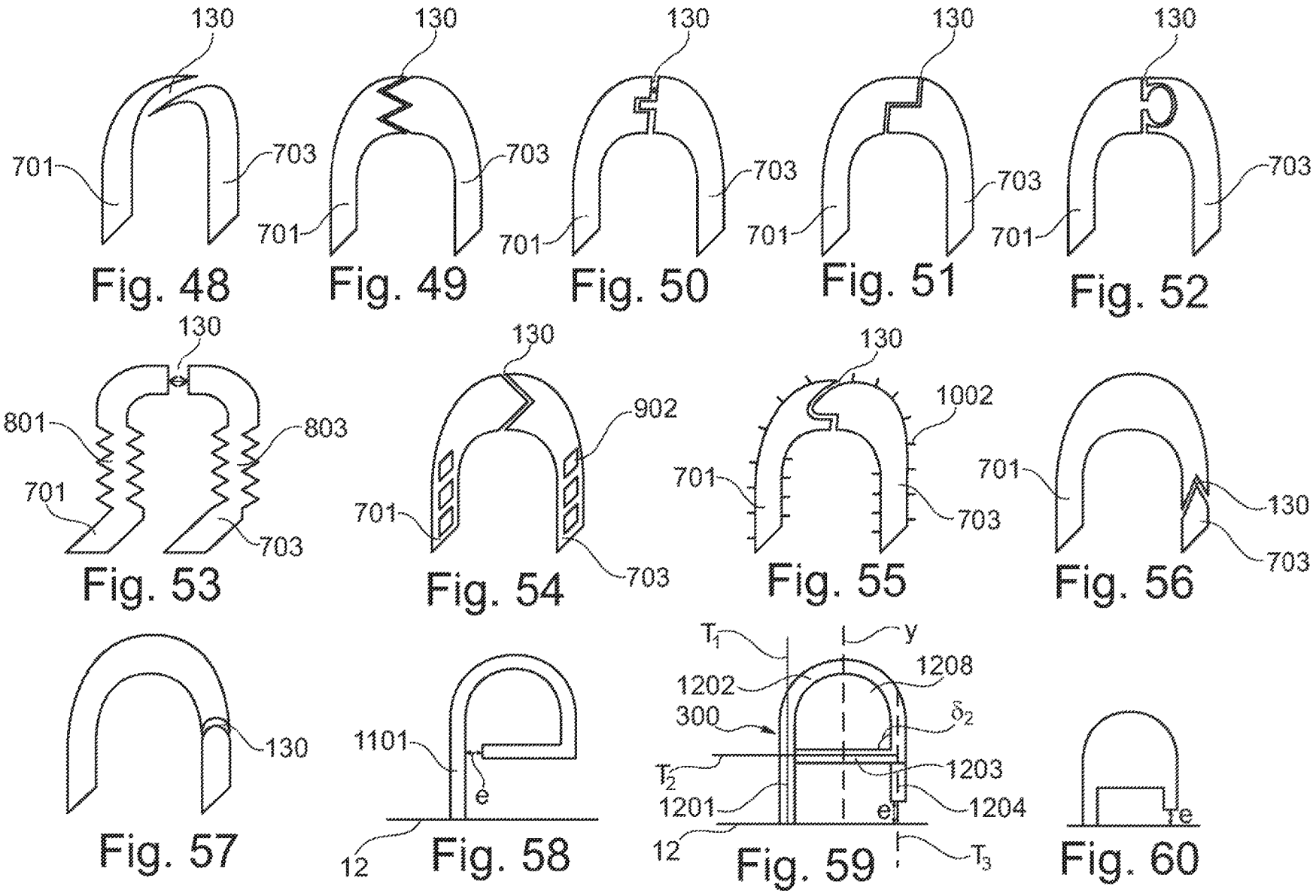
FIG. 48 shows a variant embodiment of the application member.
FIG. 49 shows a variant embodiment of the application member.
FIG. 50 shows a variant embodiment of the application member.
FIG. 51 shows a variant embodiment of the application member.
FIG. 52 shows a variant embodiment of the application member.
FIG. 53 shows a variant embodiment of the application member.
FIG. 54 shows a variant embodiment of the application member.
FIG. 55 shows a variant embodiment of the application member.
FIG. 56 shows a variant embodiment of the application member.
FIG. 57 shows a variant embodiment of the application member.
FIG. 58 shows a variant embodiment of the application member.
FIG. 59 shows a variant embodiment of the application member.
FIG. 60 shows a variant embodiment of the application member.

FIGS. 37 and 47 disclose a further example of a strand of material 300 having a non-constant cross section. In this example, the strand of material 300 has both wide base and free end, for example with a frustoconical shape.

In some embodiments, at least a portion of the strand of material 300 may be provided with a plurality of reliefs 302 over at least a surface thereof, as will now be described with reference to FIGS. 40 to 47.

Figure 41:
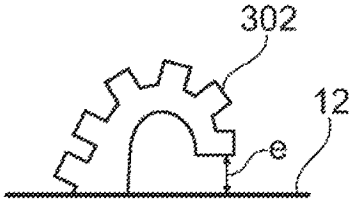
FIG. 41 shows a variant embodiment of the application member.
Figure 40:
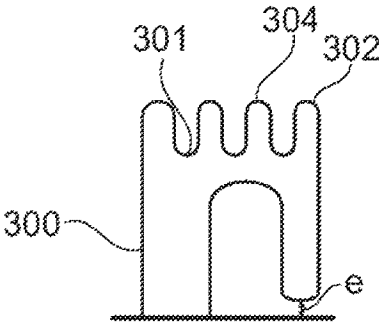
FIG. 40 shows a variant embodiment of the application member.

In the example of FIG. 40, the reliefs are present over the external surface 301 of the top part of the application member. In this example, the reliefs 302 consist of a plurality of identical periodic patterns. Each one of the patterns has a rectangular shape 304. In a variant, these reliefs 302 are present over the entire external surface of the application element as illustrated in FIG. 41.

Figure 46:
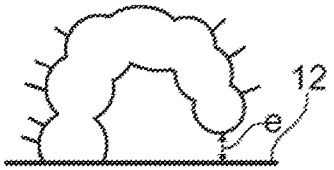
FIG. 46 shows a variant embodiment of the application member.
Figure 45:
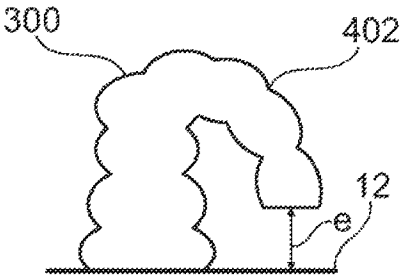
FIG. 45 shows a variant embodiment of the application member.

FIGS. 45 and 46 illustrate an example of embodiment in which annular grooves 402 are formed in the application member. Such grooves may define a recess which can accommodate the composition.

Figure 43:
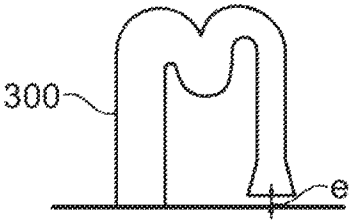
FIG. 43 shows a variant embodiment of the application member.
Figure 42:
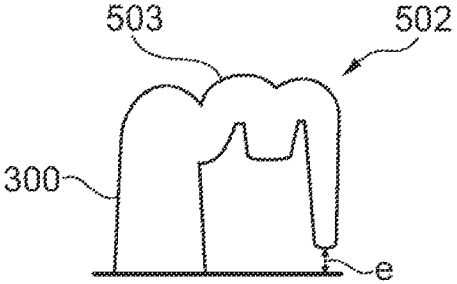
FIG. 42 shows a variant embodiment of the application member.

Furthermore, the strand of material 300 may have an undulating shape 502 over a portion of the application member 20, for example over its top part 503 as illustrated in FIGS. 42 and 43. The undulating portion may comprise a plurality of sinusoidal periodic patterns.

Figure 44:
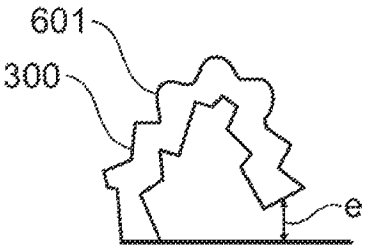
FIG. 44 shows a variant embodiment of the application member.

FIG. 44 displays an example in which the undulating shape consists on a succession of broken lines 601.

Figure 39:
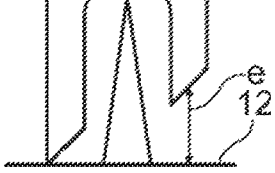
FIG. 39 shows a variant embodiment of the application member.
Figure 38:
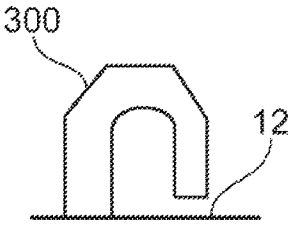
FIG. 38 shows a variant embodiment of the application member.

The contact with the central part can be flat or can be limited to a single point as disclosed in FIG. 39.

In this example, a simple spike is present inside the cavity formed by the strand of material. This spike may help to avoid deformation of the strand of the material and increase the loading capacity of the applicator.

Further examples of almost closed loops are disclosed in FIGS. 48 to 55. In these examples, the interruption 130 is positioned at the vertex of the application member 20. This interruption defines two distinct arms 701 and 702 of the application member. In the examples of figures, the two arms have a top end presenting a complementary shape.

Furthermore, the application member may have one or more protuberances. For example, the protuberance (s) may extend from at least one transverse plane of the application member as illustrated in FIGS. 54 and 55.

In a further example, at least a portion of the lateral parts 801 and 803 may be provided with a plurality of reliefs over at least a surface, external and/or internal surface, thereof. In the example of FIG. 53, the reliefs are present over both internal and external surfaces of the laterals parts.

The reliefs may consist of furrows, slots, grooves, striations, lumps, etc. Such reliefs may be of uniform dimensions, or may have varying dimensions. Typically, the depth of the reliefs may range from 0.1 mm to 3 mm, and preferably from 0.5 mm to 2 mm.

FIG. 58 illustrates another embodiment in which the hollow application member has a strand of material extending through an incomplete loop closed by a leg 1101 in such a way that it forms a P-shaped member. The cavity 14 defined inside the strand of material makes it possible to collect the composition within the applicator part. It is thus easier for the eyelashes and eyebrows to access the composition, since they do not have to be introduced as far as the central part 12 to be loaded with composition.

FIG. 59 displays a further example where the strand of material 300 has a substantially P-shape. The strand of material 300 comprises a first arm 1101 extending upward from the central part 12 along an axis $T_1$, an arch 1202 which is connected to the upper end of the first arm 1101 and which is convex towards the outside, a third arm 1203 which is connected to both the arch 1202 and the first arm 1201, this third arm 1203 has a rounded edge where it connects with the arch 1202, and extends along an axis $T_2$, and a fourth arm 1204 which is connected to the arch and extending downward along an axis $T_3$ at a non-zero distance from the central part 12.

The axis $T_2$ and $T_3$ form an angle $g_2$ therebetween. This angle may be comprised between 30° and 160°, better still between 60° and 120° preferably 90°.

Preferably, the axe $T_1$ coincides with the elongation axis Y of the application member.

The arms 1201 and 1203 form together with the arch 1202 a closed cavity 1208 where product can collect at non-zero distance from the central part.

Additionally, the arms form an almost closed cavity to increase the loading capacity of the applicator.

The gap e between the free end of the arm 1204 and the central part 12 is less than or equal to 0.3 mm, better still less than or equal to 0.2 mm, even better still less than or equal to 0.1 mm.

In a variant, as illustrated in FIG. 60, the application element is not hollow and exhibits an external surface with a shape identical to the one shown in FIG. 59.

Almost closed cavities can also be formed between two adjacent application members of one and the same element 10, when these have portions that are sufficiently close together away from their base.

This is for example the case in the examples in FIG. 5, 7 or 9, described above, when the gap e between the adjacent application members at for example the enlarged heads 60, the teeth 86 or the teeth 102 is sufficiently small, namely less than or equal to 0.3 mm, better still less than or equal to 0.2 mm, even better still less than or equal to 0.1 mm.

A small gap e can also tend to retain a certain quantity of composition outside the application members, for example in the recess 68 formed between the convex surfaces defining the top of the heads 60 in the example in FIG. 5, or in the space 94 in the example in FIG. 7. This can make it easier for the eyelashes to access the composition with which the applicator part 5 is loaded.

In these examples in FIGS. 5, 7 and 9, at least some of the application members between which these almost closed cavities are formed are hollow.

Variant embodiments without hollow application members 20 will now be described with reference to FIGS. 24 to 34.

Figure 24:
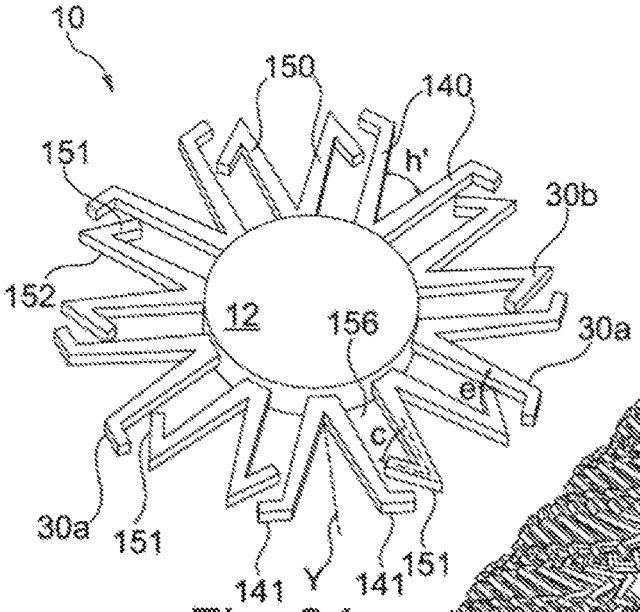
FIG. 24 shows the applicator parts produced with the elements in FIG. 23.
Figure 23:
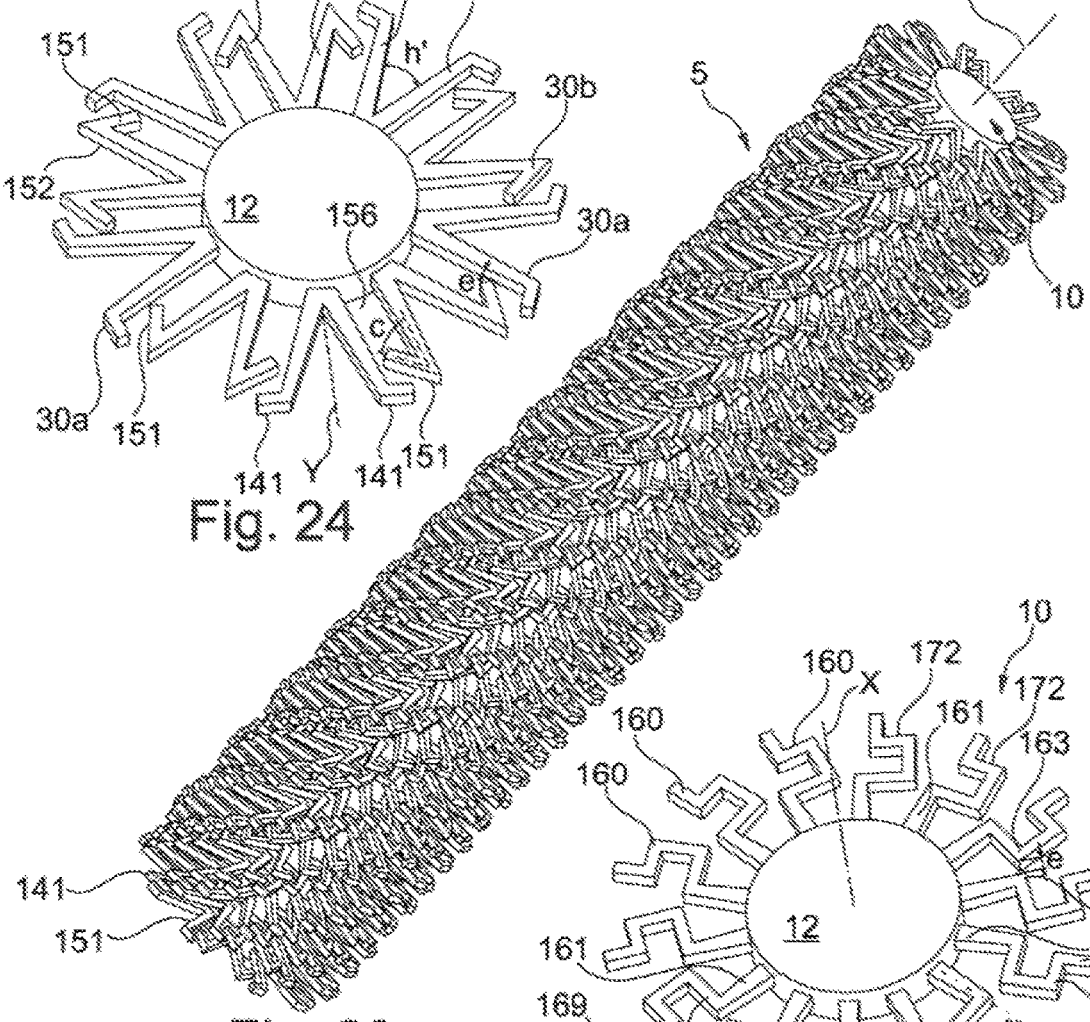
FIG. 23 is a view similar to FIG. 3 of a variant embodiment.
Figure 25:
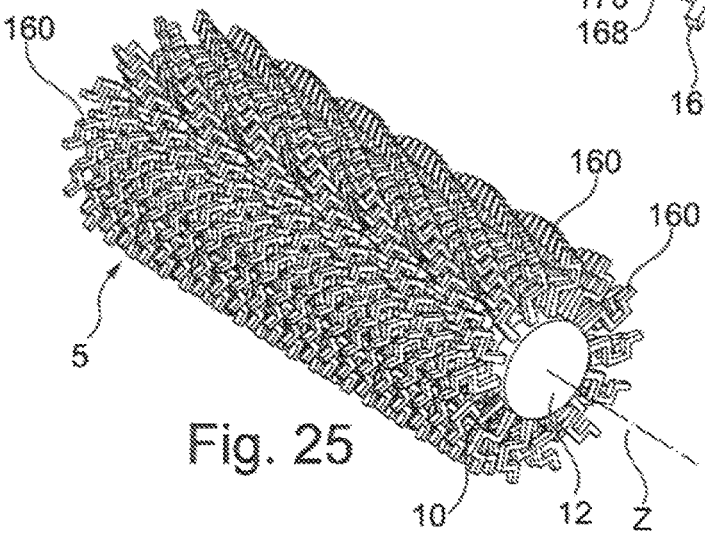
FIG. 25 is a view similar to FIG. 3 of a variant embodiment.

In the example in FIGS. 24 and 25, the element 10 has an alternation of application members 30*a* and 30*b* which follow one another in the circumferential direction around the central part 12.

The application members 30*a* and 30*b* each have the overall shape of a V, with two diverging arms 140 toward the outside for the element 30*a* and two diverging arms 150 for the element 30*b*. The opening angle k' of the V is for example between 15 and 60°, better still between 30 and 45°.

The arms 140 are bent toward the outside at their distal end and have two end portions 141 that are oriented perpendicularly to the elongation axis Y, which is an axis of symmetry for the application member and is coincident with a radius.

The arms 150 are likewise bent at their distal end, but at a greater angle than the arms 140, such that the end portions 151 formed by the elbows each form an acute angle c with the corresponding portion 152 of the arm which is joined to the central part 12.

The arms 140 meet at their base. The same goes for the arms 150.

The application members 30*a* and 30*b* thus each form two reliefs that are able to improve the catching of the eyelashes during make-up application.

Catching is particularly pronounced with the application members 30*b* on account of the orientation of the end portions 151.

In the example illustrated, the gap e between the free end of one portion 151 and the adjacent arm 140 of the neighboring application member 30*a* is small and less than 0.3 mm, better still less than 0.2 mm, even better still less than 0.1 mm, such that two application members 30*a* and 30*b* form, between one another, an almost closed cavity 156 that is able to collect a certain amount of composition.

The portions 141 and 151 can also define, between one another, a space that leads to the outside and contains composition, the latter being able to be retained between said portions on account of its viscosity. This collection of composition at a relatively large distance from the central part makes it easier for the eyelashes to access the composition.

As in the above-described examples, the elements 10 can be angularly offset from one element 10 to the next on account of the twisting of the core.

Figure 26:
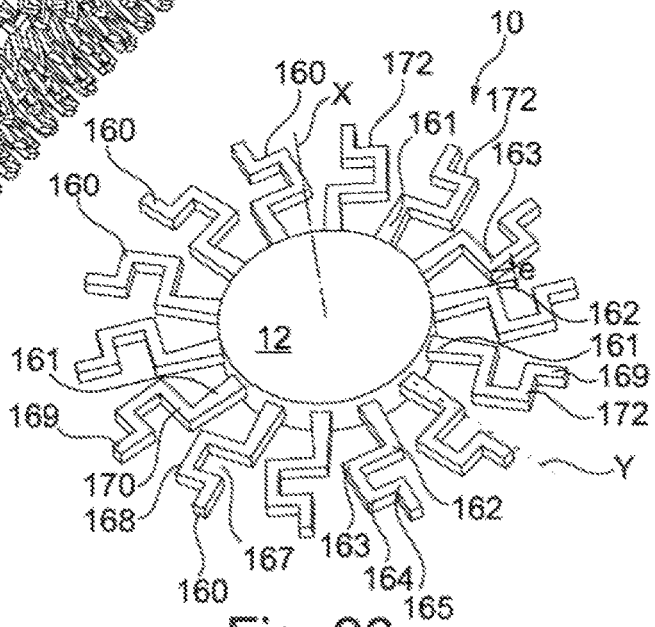
FIG. 26 shows the applicator parts produced with the elements in FIG. 25.

In the example in FIGS. 25 and 26, each element 10 of the applicator part 5 has a succession of identical application members 160, for example 14 thereof.

Each application member 160 has a leg 161 which extends along the elongation axis Y, and has four successive elbows 162 to 165, each at a right angle in the example in question.

The elbow 162 is directed in the counterclockwise direction, the elbow 163 toward the outside, the elbow 164 in the clockwise direction, and the elbow 165 toward the outside.

The elbows 163 and 164 form a groove 167, the bottom of which is defined by a segment 168 of the application member.

The distal portion of the application member is defined by a segment 169 which is parallel to the segment 168 and perpendicular to the segment 170, which forms the elbow 162 with the leg 161.

The segment 169 is offset toward the segment 168 with respect to the leg 161.

The gap e between the elbows 162 and 163 of two consecutive application members on the element 10 is relatively small, and is much less than the distance between the legs of these application members and their base.

When the gap e is less than 0.3 mm, better still less than 0.2 mm, even better still less than 0.1 mm, the legs 161 form, with the segment 168 which is directed from one of the application members toward the other, an almost closed cavity 166 in which the composition can collect.

The groove 167 makes it possible to form a reserve of composition away from the central part, thereby allowing the eyelashes to be loaded without the latter having to be dipped deeply into the applicator part.

The segment 172 which defines, with the distal segment 169, the elbow 164 also makes it possible to retain the composition on a surface radially away from the central part 12.

Moreover, the notch formed by the succession of elbows 162 to 164 forms a kind of hook that is able to improve the catching of the eyelashes on the applicator part 5.

The distal segments 169 make it possible to benefit from a surface having a high capacity for separating the eyelashes, since they make it easier to introduce the eyelashes between the application members.

Various modifications can be made to this example, notably with regard to the shape of the abovementioned notch, which may be V-shaped in one variant, in which case the number of elbows is reduced to three. In other variants, the number of elbows is higher.

Figure 27:
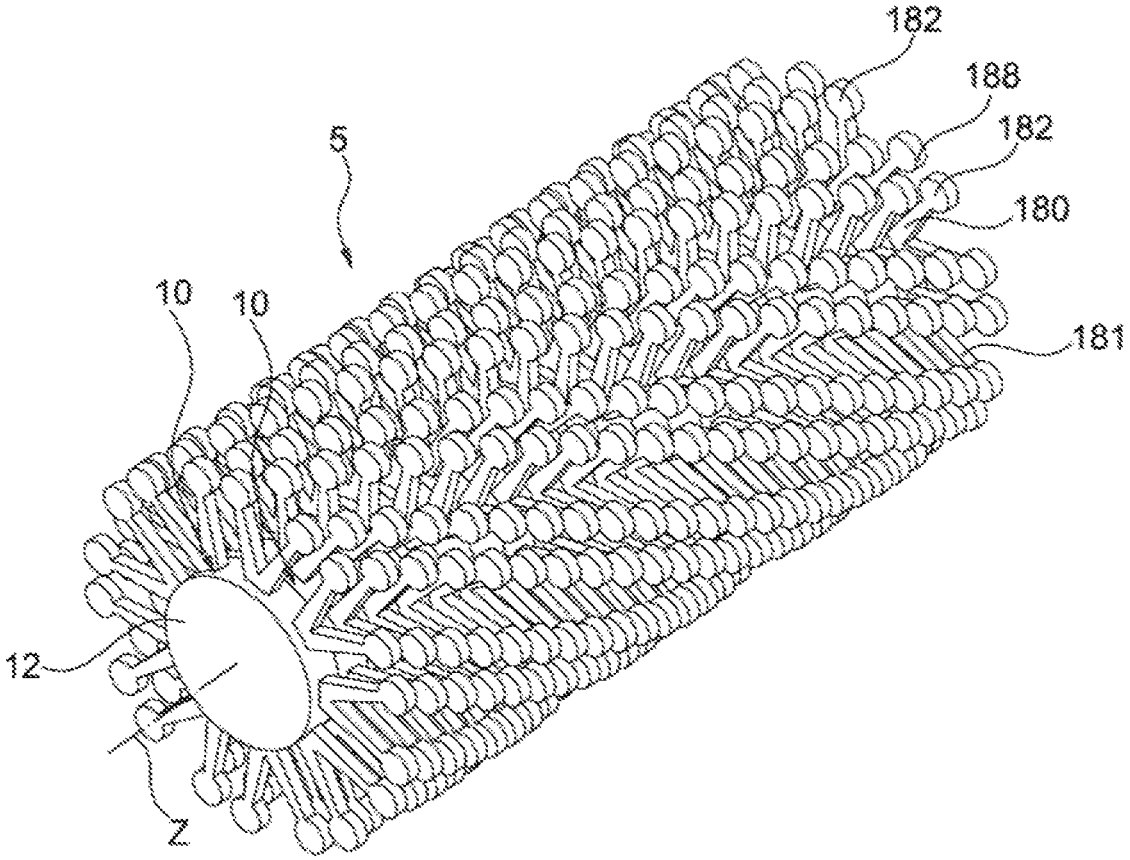
FIG. 27 is a view similar to FIG. 3 of a variant embodiment.
Figure 28:
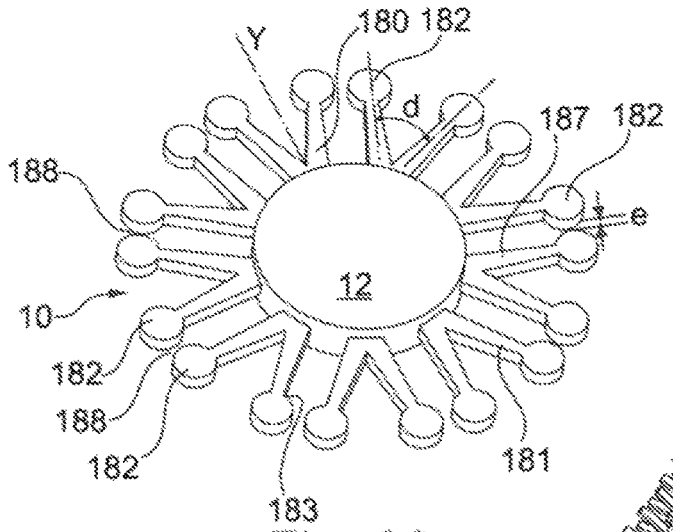
FIG. 28 shows the applicator parts produced with the elements in FIG. 27.

A variant embodiment in which the application members 180 each have the overall shape of a V, with two arms 181 diverging toward the outside, having bases that meet, and being provided at the end with enlarged heads 182 in the form of disks, will now be described with reference to FIGS. 27 and 28.

The angle d of divergence between the axes of the arms 181 is for example between 15 and 60°, better still between 30 and 45°.

Each head 182 forms, with the arm 181 to which it is joined, a discontinuity 183 which makes it possible to improve the catching of the eyelashes with the applicator part 5.

The close-together heads 182 of two consecutive application members 180 can, when the gap e between them is sufficiently small, i.e. less than or equal to 0.3 mm, better still less than or equal to 0.2 mm, even better still less than or equal to 0.1 mm, form an almost closed cavity 187, which is delimited on the inner side by the central part 12, on the sides by the arms 181, and on the outer side by the heads 182.

Finally, the heads 182 can receive a certain load of composition on their surface that faces towards the outside, thereby increasing the quantity of composition available on the outer surface of the applicator part 5. In particular, the composition can collect in the recesses 188 formed between two heads 182 if the latter are sufficiently close together for a bridge of composition to form by capillary action.

In a similar way to the above-described exemplary embodiments, the elements 10 can be angularly offset on the applicator part 5 on account of the twisting of the core.

Figure 29:
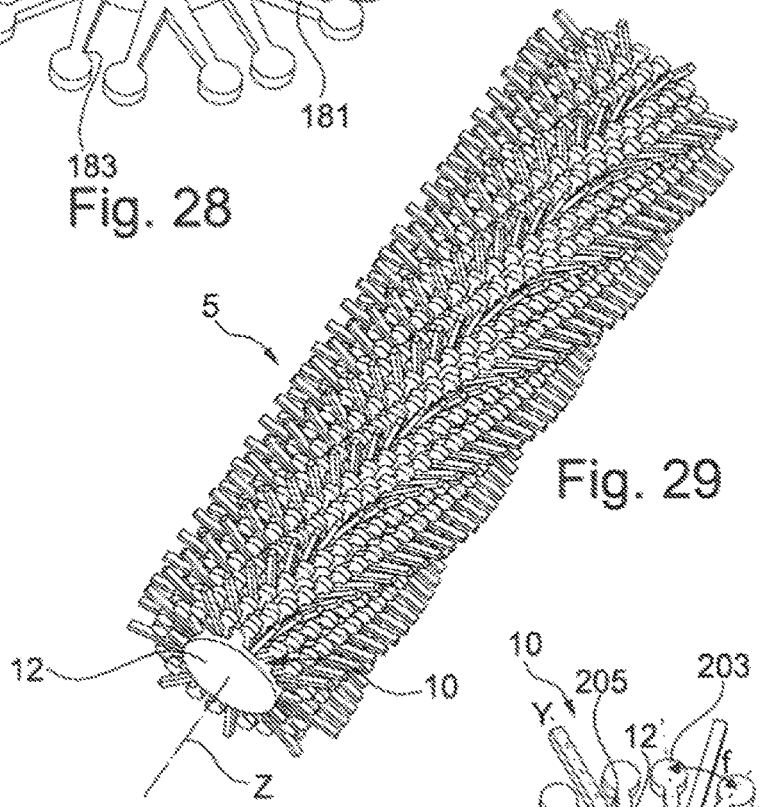
FIG. 29 is a view similar to FIG. 3 of a variant embodiment.
Figure 30:
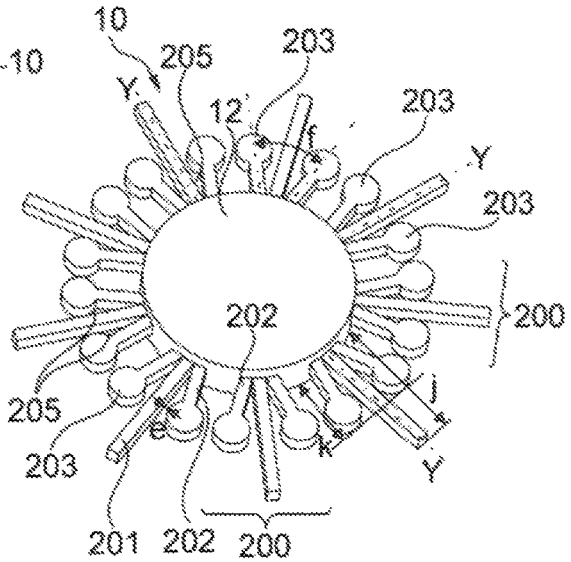
FIG. 30 shows the applicator parts produced with the elements in FIG. 29.

The exemplary embodiment shown in FIGS. 29 and 30 has application members 200 that are each formed by three arms, namely a central arm 201, which extends along the elongation axis Y of the application member 200, is longest and is formed by a simple spike, and two diverging lateral arms 202, that deviate from the central arm 201 away from the central part 12 and are each provided at their end with an enlarged head 203, for example in the form of a disk or ball.

The length j of the central arm 201 is greater than the height k of the lateral arms 202 measured at the vertex of the head 203. For example, $j>1.4$ k, better still $j>1.5$ k, and preferably $1.4\ k<j<3$ k.

The angle f of divergence between the axes of the arms 202 is for example between 15 and 60°, better still between 30 and 45°.

The arms 201 and 202 meet, for example, at their base.

The gap e between each head 203 and the central arm 201, when it is sufficiently small, i.e. less than or equal to 0.3 mm, better still less than or equal to 0.2 mm, even better still less than or equal to 0.1 mm, can make it possible to form an almost closed cavity 205 that is able to collect a certain amount of composition.

Moreover, the composition can collect on the top of the heads 203, on either side of the central arm 201. Thus, when an eyelash is introduced into the applicator part 5, it can press against the head 203 and be loaded with composition. It can also be introduced between the heads 203 of two adjacent application members 201 that are spaced further apart than the heads 203 are from the central arm. The presence of the arms 202 provided with heads makes it possible to improve the catching of the eyelashes by the applicator part 5, by virtue of the discontinuity formed at the base of the head, where it is joined to the arm, which tends to retain the eyelash.

The elements 10 can be angularly offset on account of the twisting of the core.

Figure 32:
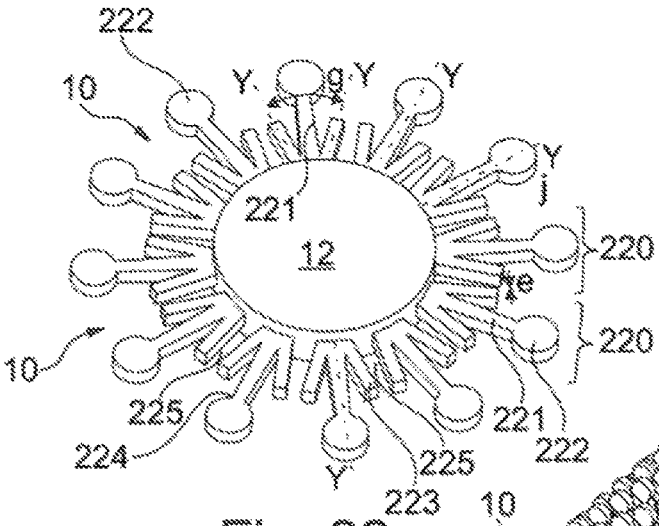
FIG. 32 shows the applicator parts produced with the elements in FIG. 31.
Figure 31:
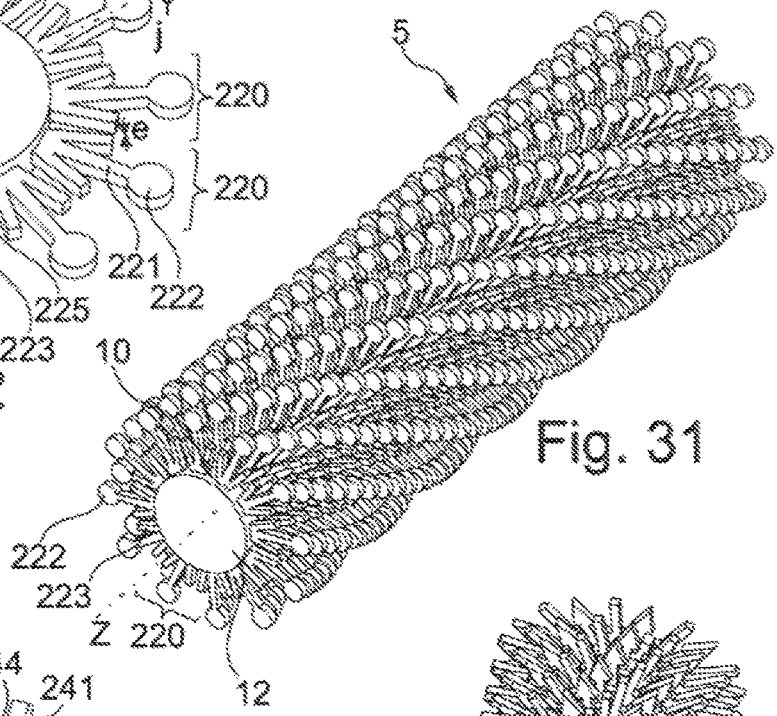
FIG. 31 is a view similar to FIG. 3 of a variant embodiment.

In the variant embodiment in FIGS. 31 and 32, each application member 220 has a central arm 221 provided at its end with an enlarged head 222, and two lateral arms 223 that are disposed on each side of the central arm 221 and diverge toward the outside. The lateral arms 223 are formed by simple spikes. The arms 221 and 223 meet at their base.

The angle g of divergence between the axes of the lateral arms 223 is for example between 15 and 60°, better still between 30 and 45°.

This angle g and the length of the lateral arms 223 can be chosen such that their ends are sufficiently close together for them to be considered to form, with the central part 12, an almost closed cavity 225.

When they are close together, the adjacent lateral arms 223 of two consecutive application members 220 of an element 10 can help to retain a certain amount of composition at the end of the arms 223, at a radial distance from the central part 12.

These arms 223 can be separated by less than 0.3 mm, better still 0.2 mm or less, even better still 0.1 mm or less.

For example, there are the following relationships between the total length of the central arm, measured at the vertex of the head 222, and the height of the lateral arms, measured along the elongation axis Y: $j>1.4$ k, better still $j>1.5$ k, and preferably $1.4\ k<j<3$ k.

The presence of the head 222 creates a discontinuity 224 at its base, which is able to improve the catching of the eyelashes by the applicator part.

Between the central arm and each lateral arm there is also a V-shaped groove that is open toward the outside, into which an eyelash can be introduced, which can help to take hold of the eyelash in order to spread the composition on its surface.

The elements 10 are angularly offset on the applicator part 5 on account of the twisting of the core 9.

Figure 34:
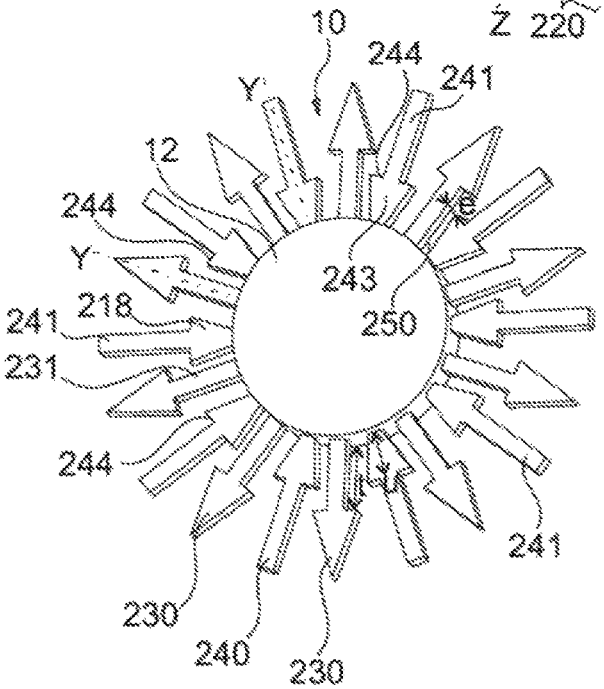
FIG. 34 shows the applicator parts produced with the elements in FIG. 33.
Figure 33:
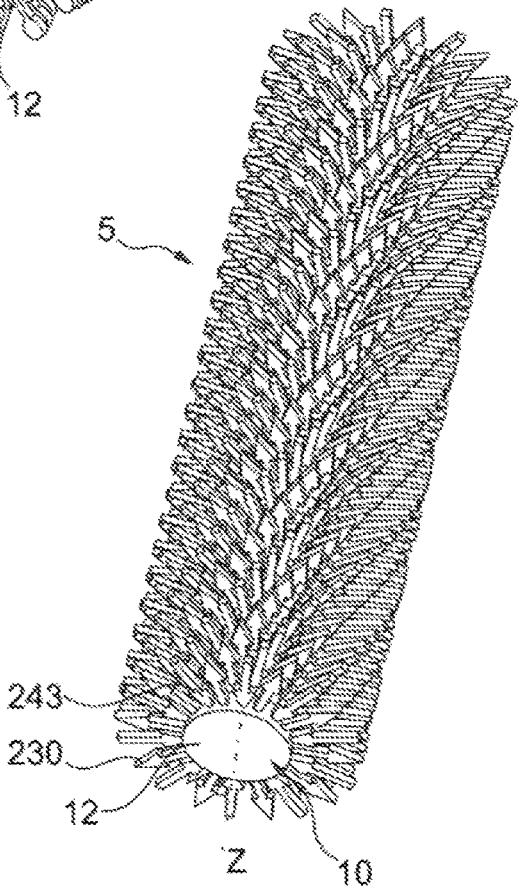
FIG. 33 is a view similar to FIG. 3 of a variant embodiment.

The variant embodiment in FIGS. 33 and 34 has an alternation of application members 230 and 240 in the circumferential direction.

The application members 230 are in the shape of an outwardly facing arrow, while the application members 240 are in the shape of an inwardly facing arrow.

Each application member 230 thus has a leg 231 by which it is joined to the central part 12 and a head 232 with a shape that tapers toward the outside, forming, at its connection to the leg, discontinuities 232 which can be oriented substantially perpendicularly to the elongation axis Y of the application member 230.

The flat part of the head 232 is in this example parallel to the flattening plane of the central part 12.

The discontinuities 233 are for example situated more than half-way along the length of the application member starting from the central part 12.

The application members 240 have a radial arm 241 which is joined to an enlarged base 243 in the form of an arrowhead directed toward the central part 12.

Discontinuities 244 are formed at the meeting point of the arm 241 and the base 243, these discontinuities 244 being oriented perpendicularly to the axis Y.

The application members 230 make it possible to grip the eyelashes by virtue of the presence of the discontinuities 233 formed by the head 232. The tapered shape of the application members 230 ensures good penetration of the eyelashes therebetween.

Each head 232 and the adjacent radial arm 241 form a sort of guide against which an eyelash can press when it is introduced into the applicator part 5, which can guide them until they cross the corresponding discontinuity 233, the gap between the head 232 and the radial arm 241 being preferably sufficient to allow the passage of an eyelash.

The discontinuities 244 allow the collection of composition at a distance from the central part 12, in a more easily accessible zone for the eyelashes than the surface of the central part 12.

When the gap e between the base 243 of an application member 240 and the leg 231 of an adjacent application member 230 is sufficiently small, notably less than or equal to 0.3 mm, better still less than or equal to 0.2 mm or even 0.1 mm, an almost closed cavity 250 can be created in the space extending between the central part 12 and the edge of the discontinuity 244 along the leg 231 and the base 243.

Such a cavity 250 makes it possible to collect composition above the surface of the central part 12. The distance between the base of the leg 231 and the origin of the base 243 at the central part 12 may be greater than the spacing e, such that the cavity 250 narrows away from the central part 12.

The difference between the height t at which the discontinuities 233 are situated with respect to the central part 12, measured along the elongation axis Y of the application member 230 in question, and the height u at which the discontinuities 244 are situated, is for example between 0 and 5 mm, better still between 0.5 and 2.5 mm, being for example around 1 mm.

The elements 10 may be angularly offset on the applicator part on account of the twisting of the core.

Of course, the invention is not limited to the examples that have just been described. For example, the number of application members may be different in each of the examples.

For example, it is possible to stack on the core elements 10 which are not identical, being made for example of different materials, notably with different hardnesses, and/or having application members with different shapes.

The core can be given a curvature, such that the applicator part extends along a curved longitudinal axis.

The elements 10 can be produced with holes 11 positioned differently on the central part 12, such that it is possible to thread the elements 10 onto the core while offsetting them angularly.

The invention claimed is:

1. An applicator for applying a cosmetic composition to eyelashes or eyebrows, comprising:

a core having a longitudinal axis, at least one element attached to the core, each element comprising a central part fitted onto the core, the central part having a circular shape with a continuous outer contour, and at least one single application member carried by the continuous outer contour of the central part, the at least one single application member being hollow and comprising at least one cavity passing through it in one direction and having a closed contour when viewed in this direction, the at least one single application member being flattened in a plane and being symmetrical with respect to said flattening plane, the contour of the cavity comprising at least three pointed arches formed by a single strand of material, the single strand of material having two extremities linked to the continuous outer contour of the central part, or having an overall shape of a harpoon comprising at least two arches, one of said two arches having an interior contour that is convex with respect to the cavity, the other of said two arches having an interior contour that is concave with respect to the cavity, said two arches being formed by a single strand of material, or at least one single application member carried by the continuous outer contour of the central part, the at least one single application member being hollow and comprising at least one cavity passing through it in one direction and having an almost closed contour with an interruption over a distance less than or equal to 0.3 mm when viewed in this direction, the interruption being formed in a lower part of said at least one single application member along the radial direction between a part of the application member and the central part, the height of said at least one single application member, measured between the vertex of the said at least one single application member and the central part, is comprised between 2 mm and 8 mm, or at least two adjacent application members carried by the continuous outer contour of the central part, and forming between one another at least one cavity passing through it in one direction and having an almost closed contour with an interruption over a short distance less than or equal to 0.3 mm when viewed in this direction, the almost close contour of the cavity extending in a plane transverse to the longitudinal axis of the core, each of the at least two adjacent application members having extremities that create a width, measured between the extremities of the application member, according to an elongation axis of said application member passing through a center of the central part, and measured perpendicularly to said elongation axis, being larger than the thickness of the application member measured along the longitudinal axis.

2. The applicator according to claim 1, wherein the at least one single application member being hollow and the cavity of the at least one single application member having the closed contour, the cavity of the at least one single application member being formed by a strand of material extending through a complete loop.

3. The applicator according to claim 2, wherein the complete loop is located on the at least one single application member at a non-zero distance from the central part.

4. The applicator according to claim 3, wherein the loop forms an enlarged head that is joined to the central part by a leg that is narrower than the head.

5. The applicator according to claim 4, wherein the head has the overall shape of a harpoon, almost closed cavities being formed between two consecutive application members, the distance between the heads being less than or equal to 0.3 mm.

6. The applicator according to claim 1, wherein the at least one single application member having a base and a head that are linked by a stem that is narrower than the base and the head.

7. The applicator according to claim 6, wherein the head and the base form between one another at least one groove that is open in the circumferential direction.

8. The applicator according to claim 1, wherein the at least one single application member is toothed at its periphery.

9. The applicator according to claim 1, wherein the pointed arches are concave toward the outside.

10. The applicator according to claim 9, wherein almost closed cavities are formed between the teeth of two consecutive single application members, the distance between these teeth being less than or equal to 0.3 mm.

11. The applicator according to claim 1, wherein the at least one single application member widens toward the outside, being formed by two lateral arches of said pointed arches linked by a top arch of said pointed arches, the lateral and top arches forming teeth at their meeting point.

12. The applicator according to claim 11, wherein the top arch is concave toward the outside.

13. The applicator according to claim 11, wherein the top arch is concave toward the outside, almost closed cavities being formed between two consecutive single application members, the distance between the teeth being less than or equal to 0.3 mm.

14. The applicator according to claim 1, wherein the at least one single application member is multilobed at its periphery.

15. The applicator according to claim 14, wherein the lobes are formed by said pointed arches that are convex toward the outside.

16. The applicator according to claim 14, wherein the lobes are formed by said pointed arches that are convex toward the outside, the application member being in the shape of an arrowhead.

17. The applicator according to claim 1, wherein the at least one single application member has a strand of material extending through an incomplete loop closed by the central part which forms the cavity.

18. The applicator according to claim 1, wherein the at least one single application member has a radially outer edge that is convex toward the outside.

19. The applicator according to claim 1, wherein the at least one single application members and/or the at least two adjacent application members of an element meet at their base.

20. The applicator according to claim 1, wherein at least one element has, in the circumferential direction, an alternation of hollow single application members, and/or two adjacent application members, and solid application members.

21. The applicator according to claim 1, wherein a spacing between the single application members and/or the two adjacent application members at their base is greatest at their base.

22. The applicator according to claim 1, wherein a spacing between the single application members and/or the two adjacent application members is smallest at their base.

23. The applicator according to claim 1, wherein the elongation axes of the application members of an element are coplanar.

24. The applicator according to claim 1, wherein the single application members and/or the two adjacent application members of an element are flattened in a plane, said flattening plane is oriented in a plane containing the axis of the central part.

25. The applicator according to claim 1, wherein the at least one single application member has a shape that is symmetric with respect to a median plane containing the elongation axis of the application member and perpendicular to the flattening plane.

26. A packaging and application device having:

a container containing a composition to be applied, an applicator according to claim 1.

27. A method for a cosmetic treatment of eyelashes and/or eyebrows, comprising the step of applying a cosmetic composition to the eyelashes with the aid of an applicator according to claim 1.

28. The applicator according to claim 1, wherein, the at least one single application member is carried by the central part comprising the at least one cavity passing through it in one direction and having the almost closed contour with the interruption when viewed in this direction, the interruption is form between the central part and said at least one single application member or between two parts of said at least one single application member.

29. An applicator for applying a cosmetic composition to eyelashes or eyebrows, comprising:

a core having a longitudinal axis, at least one element attached to the core, each element comprising a central part fitted onto the core, the central part having a circular shape with a continuous outer contour, and at least one single application member carried by the continuous outer contour of the central part, the at least one single application member being hollow and comprising at least one cavity passing through it in one direction and having a closed contour when viewed in this direction, the at least one single application member being flattened in a plane and being symmetrical with respect to said flattening plane, the contour of the cavity comprising at least three pointed arches formed by a single strand of material, the single strand of material having two extremities linked to the continuous outer contour of the central part, or having an overall shape of a harpoon comprising at least two arches, one of said two arches being convex with respect to the cavity, the other of said two arches having an interior contour that is concave with respect to the cavity, said two arches being formed by a single strand of material.

30. An applicator for applying a cosmetic composition to eyelashes or eyebrows, comprising:

a core having a longitudinal axis, at least one element attached to the core, each element comprising a central part fitted onto the core, the central part having a circular shape with a continuous outer contour, and at least one single application member carried by the continuous outer contour of the central part, the at least one single application member being hollow and comprising at least one cavity passing through it in one direction and having an almost closed contour with an interruption over a short distance less than or equal to 0.3 mm when viewed in this direction, the interruption being formed in a lower part of said at least one single application member along the radial direction between a part of the application member and the central part, the height of said at least one single application member, measured between the vertex of the said at least one single application member and the central part, is comprised between 2 mm and 8 mm.

31. An applicator for applying a cosmetic composition to eyelashes or eyebrows, comprising:

a core having a longitudinal axis, at least one element attached to the core, each element comprising a central part fitted onto the core, the central part having a circular shape with a continuous outer contour, and at least two adjacent application members carried by the continuous outer contour of the central part, and forming between one another at least one cavity passing through it in one direction and having an almost closed contour with an interruption over a short distance less than or equal to 0.3 mm when viewed in this direction, the almost close contour of the cavity extending in a plane transverse to the longitudinal axis of the core, each of the at least two adjacent application members having extremities that create a width, measured between the extremities of the application member, according to an elongation axis of said application member passing through a center of the central part, and measured perpendicularly to said elongation axis, being larger than the thickness of the application member measured along the longitudinal axis.

* * * * *